US005316886A

United States Patent [19]

Koide et al.

[11] Patent Number: 5,316,886

[45] Date of Patent: * May 31, 1994

[54] HEAT DEVELOPABLE PHOTOSENSITIVE MATERIALS

[75] Inventors: Tomoyuki Koide; Tetsuro Kojima, both of Kanagawa, Japan

[73] Assignee: Fuji Photo Film Co., Ltd., Kanagawa, Japan

[ * ] Notice: The portion of the term of this patent subsequent to Jan. 21, 2009 has been disclaimed.

[21] Appl. No.: 700,282

[22] Filed: May 15, 1991

[30] Foreign Application Priority Data

May 16, 1990 [JP] Japan ..... 2-125850
Aug. 1, 1990 [JP] Japan ..... 2-204428

[51] Int. Cl.[5] ..... G03C 1/34

[52] U.S. Cl. ..... 430/203; 430/353; 430/600; 430/603; 430/607; 430/611; 430/613

[58] Field of Search ..... 430/617, 607, 611, 600, 430/603, 613, 203, 353, 219

[56] References Cited

U.S. PATENT DOCUMENTS

| | | | |
|---|---|---|---|
| 4,657,847 | 4/1987 | Ikeda et al. | 430/611 |
| 4,719,168 | 1/1988 | Nakamura et al. . | |
| 4,859,580 | 8/1989 | Aono et al. . | |
| 4,886,738 | 12/1989 | Deguchi et al. . | |
| 4,892,807 | 1/1990 | Hirabayashi et al. | 430/611 |
| 4,912,026 | 3/1990 | Miyoshi et al. | 430/611 |
| 4,951,561 | 5/1984 | Hirabayashi et al. | 430/611 |
| 4,966,833 | 10/1990 | Inoue . | |
| 5,082,763 | 1/1992 | Kojima et al. | 430/611 |
| 5,817,454 | 5/1991 | Nakamine et al. . | |

*Primary Examiner*—Thorl Chea
*Attorney, Agent, or Firm*—Sughrue, Mion, Zinn, Macpeak & Seas

[57] ABSTRACT

A heat developable photosensitive material is disclosed, comprising a support having thereon at least one photosensitive silver halide emulsion layer which contains (i) at least one compound selected from among the compounds represented by formulae (I) and (III) and (ii) a dye compound represented by formula (LI):

[I]

[III]

(Dye—Y)n—Z (LI)

the definition of Y, R, R', M, T, U, n, m and for formula (I) and (III) and Y, Z and n for dye of formula (LI) are as defined in the specification.

8 Claims, No Drawings

HEAT DEVELOPABLE PHOTOSENSITIVE MATERIALS

FIELD OF THE INVENTION

This invention concerns heat developable photosensitive materials, and in particular it concerns heat developable materials which have excellent image discrimination characteristics, which is to say a high maximum density and a low minimum density.

BACKGROUND OF THE INVENTION

Heat developable photosensitive materials in which silver halides are used as photosensitive components are known in this field of technology. For example, disclosures of these materials have been made on pages 242–255 of *Fundamentals of Photographic Engineering*, "Non-silver Salt Edition" (published by Corona, 1982), on page 40 of the April 1978 issue of Image Report, on pages 32–33 of *Nebletts, Handbook of Photography and Reprography* (7th Edition, published by Van Nostrand Reinhold Company), in U.S. Pat. Nos. 3,152,904, 3,301,678, 3,392,020 and 3,457,075, British Patents 1,131,108 and 1,167,777, and on pages 9 to 15 of *Research Disclosure* (referred to hereinafter as RD) of June 1978.

Many methods have been proposed for obtaining color images by thermal development.

For example, methods in which color images are formed by bonding couplers and the oxidized forms of developing agents which have been formed by the reduction of silver halides have been disclosed, for example, in U.S. Pat. Nos. 3,531,286, 3,761,270 and 4,021,240, Belgian Patent 802,519 and RD 13742.

Furthermore, methods in which positive dye images are formed by thermal development using a silver dye bleach method in which silver halides are used have been disclosed in U.S. Pat. No. 4,235,957, RD 14433 and RD 15227.

Moreover, (1) methods in which diffusible dyes are imagewise formed or released from dye providing compounds along with the thermal development of a silver halide and in which these diffusible dyes are transferred to a dye fixing element which has a mordant by means of a solvent such as water, (2) methods in which transfer to a dye fixing element is achieved by means of a high boiling point organic solvent, (3) methods in which transfer to a dye fixing element is achieved by means of a hydrophilic thermal solvent which is incorporated into the dye fixing element, and (4) methods in which a mobile dye is subjected to thermal diffusion or sublimation and transferred to a dye receiving element, such as a support, have been proposed. With these methods it is also possible to obtain negative dye images and positive dye images with respect to the original, sometimes by changing the type of dye providing compound which is used and sometimes by changing the type of silver halide emulsion which is used (U.S. Pat. Nos. 4,463,079, 4,474,867, 4,478,927, 4,507,380, 4,500,626 and 4,483,914, JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-62-65038, JP-A-61-23245, and European Patents 210,660A2 and 220,746A2 (the term "JP-A" as used herein means an "unexamined published Japanese patent application")).

However, heat developable photosensitive materials of the type described above are developed at high temperatures and are therefore different from normal photosensitive materials which are developed at about room temperature. Fogging (a lowering of the $D_{max}$ in photosensitive materials which have a positive-positive response) occurs to a marked degree and it is difficult to obtain photographs which have high image discrimination characteristics (S/N).

Hydroxytetraazaindenes and benzotriazoles, for example, are known as anti-foggants for normal photosensitive materials which are developed and processed at temperatures close to room temperature. But the initial antifoggant objective is not achieved when these compounds are used in heat developable photosensitive materials and, moreover, they result in a loss of photographic speed.

Furthermore, heat developable photosensitive materials which have improved S/N have been disclosed, for example, in JP-A-59-168442, JP-A-59-111636, JP-A-59-177550, JP-A-60-168545, JP-A-60-180199, JP-A-60-180563, JP-A-61-53633, JP-A-62-78554, JP-A-62-123456, JP-A-63-133144, JP-A-2-44336 and JP-A-2-211442, but it has not been possible to realize objective mentioned above.

SUMMARY OF THE INVENTION

In order to realize the aforementioned objectives, a heat developable photosensitive material of the present invention comprises a support having thereon at least one photosensitive silver halide emulsion layer, wherein there is contained at least one compound selected from among the compounds represented by formulae [I], [II] and [III].

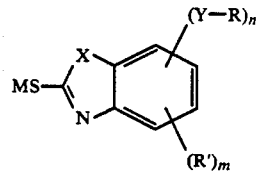

[I]

In this formula, Y represents

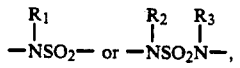

and R represents an alkyl group, an alkenyl group, a cycloalkyl group, an aryl group or an aralkyl group. X represents —O—, —S— or

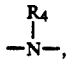

and M represents a hydrogen atom, an alkali metal atom, an ammonium group or a group which cleaves under alkaline conditions R' represents a hydrogen atom or a substituent group, and $R_1$, $R_2$, $R_3$ and $R_4$ each represent a hydrogen atom or an alkyl group.

Moreover, n represents 1 or 2, and m represents 4—n.

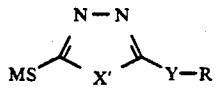

[II]

In this formula, X' represents —O—, —S— or —NH—. Y, R and M have the same meanings as the respective groups in formula [I].

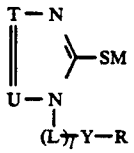

[III]

In this formula, T and U each represent

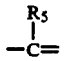

or —N=, and $R_5$ represents a hydrogen atom, a halogen atom, a hydroxyl group, a nitro group, an alkyl group, an alkenyl group, an aralkyl group, an aryl group, a carbonamido group, a sulfonamido group, a ureido group or a thioureido group.

L represents an alkylene group, an alkenylene group, an aralkylene group or an arylene group, and l represents 0 or 1.

Y, R and M have the same meanings as the respective groups in formula [I].

DETAILED DESCRIPTION OF THE INVENTION

The compounds of formulae [I], [II]and [III] are described in detail below.

In formula [I], Y represents

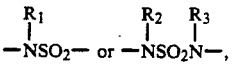

and R represents a linear chain or branched alkyl group which has from 1 to 10 carbon atoms (for example, methyl, ethyl, propyl, isopropyl, butyl, t-butyl, pentyl, hexyl, heptyl), a linear chain or branched alkenyl group which has from 2 to 10 carbon atoms (for example, vinyl, propenyl, 1-methylvinyl), a cycloalkyl group which has from 3 to 10 carbon atoms (for example, cyclopropyl, cyclopentyl, cyclohexyl, 4methylcyclohexyl), an aryl group which has from 6 to 12 carbon atoms (for example, phenyl, 4-methylphenyl), or a aralkyl group which has from 6 to 12 carbon atoms (for example, benzyl).

X represents —O—, —S— or

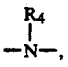

and M represents a hydrogen atom, an alkali metal atom (for example, sodium, potassium), an ammonium group (for example, trimethylammonium chloride, dimethylbenzylammonium chloride) or a group such that, under alkaline conditions, X can become a hydrogen atom or an alkali metal (for example, acetyl, cyanoethyl, methanesulfonylethyl)

Furthermore, R' represents a hydrogen atom or a substituent group. Examples of substituent groups include halogen atoms (for example, fluorine, chlorine, bromine), substituted or unsubstituted alkyl groups which have from 1 to 6 carbon atoms (for example, methyl, trifluoromethyl, ethyl, n-butyl), substituted or unsubstituted aryl groups which have from 6 to 12 carbon atoms (for example, phenyl, 4-methylphenyl), substituted or unsubstituted alkoxy groups which have from 1 to 6 carbon atoms (for example, methoxy, ethoxy), substituted or unsubstituted aryloxy groups which have from 6 to 12 carbon atoms (for example, phenoxy, 4-methylphenoxy), sulfonyl groups which have from 1 to 12 carbon atoms (for example, methanesulfonyl, p-toluenesulfonyl), sulfamoyl groups which have from 1 to 12 carbon atoms (for example, diethylsulfamoyl, phenylsulfamoyl), carbamoyl groups which have from 1 to 12 carbon atoms (for example, unsubstituted carbamoyl, methylcarbamoyl, phenylcarbamoyl), amido groups which have from 2 to 12 carbon atoms (for example, acetamido, benzamido), ureido groups which have from 1 to 12 carbon atoms (for example, unsubstituted ureido, 3-methylureido, 3-phenylureido), aryl or alkyl oxycarbonyl groups which have from 2 to 12 carbon atoms (for example, methoxycarbonyl, phenoxycarbonyl), aryl or alkyl oxycarbonylamino groups which have from 2 to 12 carbon atoms (for example, methoxycarbonylamino, phenoxycarbonylamino), and a cyano group.

$R_1$, $R_2$, $R_3$ and $R_4$ represent hydrogen atoms or alkyl groups which have from 1 to 6 carbon atoms (for example, methyl, ethyl, propyl, hexyl).

Moreover, n represents 1 or 2, and m represents 4—n.

Formula [III] is described in detail below.

In formula [III], T and U represent

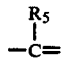

or —N=, and $R_5$ represents a hydrogen atom, a halogen atom (for example, chlorine, bromine), a hydroxyl group, a nitro group, an alkyl group which has from 1 to 6 carbon atoms (for example, methyl, ethyl, methoxyethyl, n-butyl, 2-ethylhexyl), an alkenyl group which has from 2 to 6 carbon atoms (for example, allyl), an aralkyl group which has from 7 to 12 carbon atoms (for example, benzyl, 4-methylbenzyl, phenethyl, 4-methoxybenzyl), an aryl group which has from 6 to 12 carbon atoms (for example, phenyl, naphthyl, 4-methanesulfonamidophenyl, 4-methylphenyl), a carbonamido group which has from 1 to 12 carbon atoms (for example, acetylamino, benzoylamino, methoxypropionylamino), a sulfonamido group which has from 1 to 12 carbon atoms (for example, methanesulfonamido, benzenesulfonamido, p-toluenesulfonamido), a ureido group which has from 1 to 12 carbon atoms (for example, unsubstituted ureido, methylureido, phenylureido), or a thioureido group which has from 1 to 12 carbon atoms (for example, unsubstituted thioureido, methylthioureido, methoxyethylthioureido, phenylthioureido).

L represents a linear chain or branched alkylene group which has from 1 to 6 carbon atoms (for example, methylene, ethylene, propylene, butylene, hexylene, 1-methylethylene), a linear chain or branched alkenylene group which has from 1 to 6 carbon atoms (for example, vinylene, 1-methylvinylene), a linear chain or branched aralkylene group which has from 7 to 12 carbon atoms (for example, benzylidene), or an arylene group which has from 6 to 12 carbon atoms (for example, phenylene), and l represents 0 or 1.

Y, R and M have the same meanings as the respective groups in formula [I].

In formulae [I], [II] and [III], Y preferably represents —$NHSO_2$—, R preferably represents an alkyl group which has from 1 to 4 carbon atoms, and n preferably represents 1. R′ preferably represents a hydrogen atom or an alkyl group which has from 1 to 4 carbon atoms. $R_5$ preferably represents a hydrogen atom or an alkyl group which has from 1 to 4 carbon atoms, L preferably represents an alkylene group which has from 1 to 4 carbon atoms or an arylene group which has from 6 to 8 carbon atoms, and l preferably represents 1.

Of the compounds of formulae [I], [II] and [III], those of formula [I] are especially desirable.

Specific examples of compounds which can be represented by formulae [I], [II] and [III] are indicated below, but the compounds of the present invention are not limited to these examples.

(1)

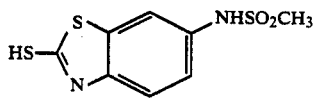

(2)

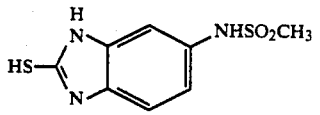

(3)

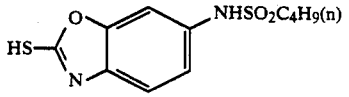

(4)

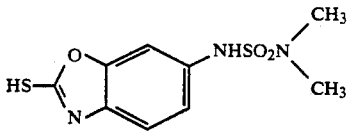

(5)

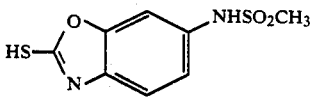

(6)

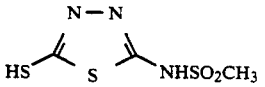

(7)

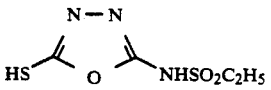

(8)

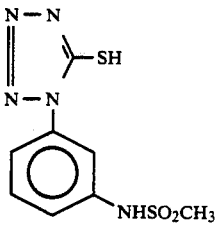

(9)

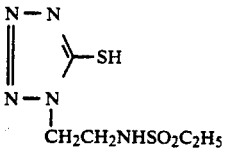

-continued (10)

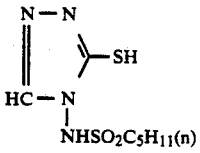

(11)

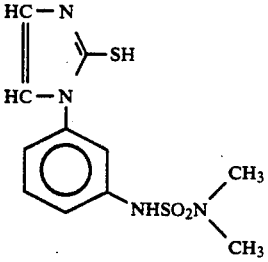

(12)

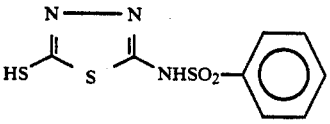

(13)

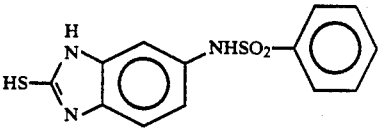

(14)

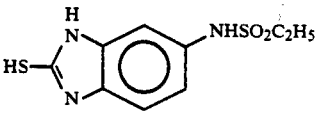

(15)

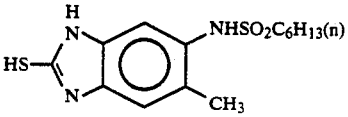

(16)

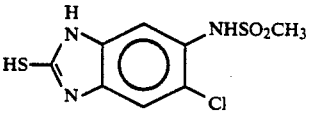

(17)

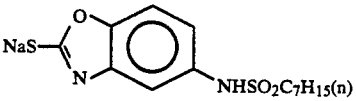

(18)

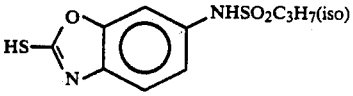

(19)

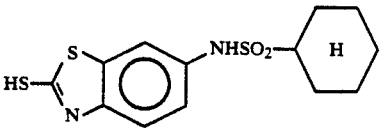

(20)

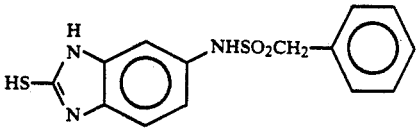

-continued (21)

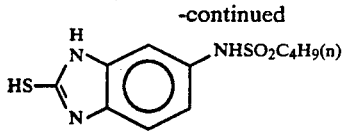

(22)

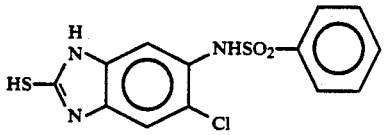

(23)

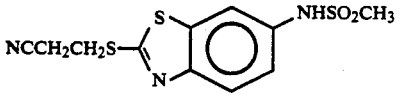

(24)

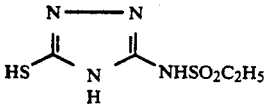

(25)

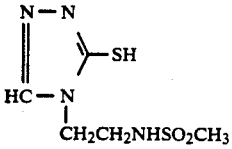

Compounds represented by general formula [I] which can be used in the present invention can be prepared easily using the methods disclosed in *Organic Synthesis*, IV, 569 (1963), *Journal of the American Chemical Society*, 45, 2390 (1923), *Chemische Berichte*, 9, 465 (1876) and JP-A-61-99121.

Compounds represented by formula [II] which can be used in the present invention can be prepared with reference to *Advances in Heterocyclic Chemistry*, volume 9, pages 165–209 (1968), *Journal of Pharmaceutical Society Japan*, volume 71, pages 1481–1484 (1951), U.S. Pat. No. 2,823,208 and JP-A-61-156646.

Compounds represented by formula [III] which can be used in the present invention can be prepared easily using the methods disclosed in *Berichte der Deutschen Chemicthen Gesellschaft*, 28, 77 (1895), JP-A-50-37436, JP-A-51-3231, U.S. Pat. Nos. 3,295,976, 3,376,310, 2,585,388 and 2,541,924, *Chemical Abstracts*, 58, 7921g (1963), I. I. Kovtunovskaya - Leveshina, *Tr. Ukr. Eksperim. Endokrinol.*, 18, page 345 (1961), M. Chamben et al., *Bull Soc.*, 79, page 4922 (1957) and A. Wohl, W. Marckwald, *German Chemical Society Journal (Ber)*, 22, page 568 (1889).

Furthermore, these compounds can be prepared by the examples of synthesis described below.

SYNTHESIS EXAMPLE 1 (PREPARATION OF ILLUSTRATIVE COMPOUND 1)

Dimethylacetamide (50 ml) was added to 9.1 grams of 6-amino-2-mercaptobenzothiazole to form a solution and, after adding 4.7 ml of pyridine, 4.7 ml of methanesulfonylchloride was added dropwise at a temperature below 0° C. After reacting for 1 hour at room temperature, the mixture was added to 500 ml of ice water and the crystals which precipitated out were collected by filtration and recrystallized from a mixed dimethylacetamide/methyl alcohol (1:9 by volume) solvent, and 6.6 grams of the target compound was obtained.

Melting Point 270°–273° C.

SYNTHESIS EXAMPLE 2 (PREPARATION OF ILLUSTRATIVE COMPOUND 2)

The target compound (5.9 grams) was prepared in the same way as in Synthesis Example 1 except that 9.2 grams of 5-amino-2-mercaptobenzimidazole was used.

Melting Point 264°–266° C.

SYNTHESIS EXAMPLE 3 (PREPARATION OF ILLUSTRATIVE COMPOUND 5)

The target compound (5.2 grams) was prepared in the same way as in Synthesis Example 1 except that 8.4 grams of 6-amino-2-mercaptobenzimidazole was used.

Melting Point 251°–252° C.

Compounds such as these may be used individually, or two or more such compounds can be used conjointly. Compounds such as these may be added to any layer in the heat developable photosensitive material, but they are preferably added to a photosensitive layer or a layer adjacent thereto (for example, an interlayer or a protective layer), and they are most desirably added to a photosensitive layer.

The amount added should be from $10^{-6}$ mol to 1 mol, and preferably from $10^{-4}$ to $10^{-1}$ mol, per mol of photosensitive silver halide.

In the present invention, the above mentioned compounds can be added during any process of the manufacture of the photographic emulsion or at any stage after the manufacture of the photographic emulsion until immediately before coating. But in general, addition at any stage after the manufacture of the photographic emulsion until immediately before coating is preferred.

The heat developable photosensitive materials of the present invention comprise fundamentally photosensitive silver halides and binders on a support. They may also contain organometallic salt oxidizing agents and dye providing compounds (along with reducing agents in some cases, as described hereinafter), as required. These components are often added to the same layer, but if they are in a state where they can react with one another they can also be separated and added to different layers. Any loss of photographic speed is prevented, for example, if a colored dye providing compound is present in a layer below the silver halide emulsion. Reducing agents are preferably incorporated in the heat developable photosensitive materials, but they may be supplied from the outside using methods in which they diffuse from a dye fixing material as will be described hereinafter, for example.

Combinations of at least three silver halide emulsion layers which are photosensitive to different spectral regions are used in order to obtain a wide range of colors on the chromaticity chart using the three primary colors yellow, magenta and cyan. For example, there are blue sensitive layer, green sensitive layer and red sensitive layer triple layer combinations and green sensitive layer, red sensitive layer and infrared photosensitive layer combinations. The photosensitive layers can be arranged in a variety of arrangements and orders formed in general type color photosensitive materials. Furthermore, each photosensitive layer can be divided into two or more layers, as required.

Various auxiliary layers, such as protective layers, subbing layers, interlayers, yellow filter layers, anti-halation layers and backing layers, for example, can also be established in the heat developable photosensitive material.

All of the silver halides, including silver chloride, silver bromide, silver iodobromide, silver chlorobromide, silver chloroiodide and silver chloroiodobromide, can be used in the present invention.

The silver halide emulsions used in the present invention may be surface latent image type emulsions or internal latent image type emulsions. Internal latent image type emulsions are used in combination with a nucleating agent or fogging by light as direct reversal emulsions. Furthermore, the emulsion may be a so-called core/shell emulsion in which the interior of the grain and the grain surface layer comprise different phases The silver halide emulsions may be mono-disperse or poly-disperse, and mixtures of mono-disperse emulsions can be used. The grain size is from 0.1 to 2$\mu$, and more desirably from 0.2 to 1.5$\mu$. The crystal habit of the silver halide grains may be cubic, octahedral, tetradecahedral, tabular with a high aspect ratio or of some other form.

In practice, any of the silver halide emulsions disclosed, for example, in column 50 of U.S. Pat. No. 4,500,626, U.S. Pat. No. 4,628,021, RD 17029 (1978) and JP-A-62-253159 can be used.

The silver halide emulsions can be used as they are primitive, but they are generally used after chemical sensitization. The methods of sulfur sensitization, reduction sensitization and noble metal sensitization, for example, known for the emulsions of conventional photosensitive elements can be used individually or in combinations. These methods of chemical sensitization can also be carried out in the presence of nitrogen containing heterocyclic compounds (JP-A-62-253159).

The coated weight of photosensitive silver halide used in the present invention is within the range from 1 mg to 10 grams, calculated as silver, per square meter.

In the present invention, organometallic salts can be used conjointly with the photosensitive silver halides as oxidizing agents. The use of organic silver salts from among these organometallic salts is especially desirable.

The benzotriazoles, fatty acids and other compounds disclosed, for example, in columns 52–53 of U.S. Pat. No. 4,500,626 can be cited as organic compounds which can be used to form the organic silver salt oxidizing agents mentioned above. Furthermore, the silver salts of carboxylic acids which have alkynyl groups, such as the silver phenylpropiolate disclosed in JP-A-60-113235, and the silver acetylenes disclosed in JP-A-61-249044, can also be used Two or more organic silver salts can be used conjointly.

The above mentioned organic silver salts can be used conjointly in amounts of from 0.01 to 10 mol, and preferably of from 0.01 to 1 mol, per mol of photosensitive silver halide. The total amount of photosensitive silver halide and organic silver salt coated is suitably from 50 mg to 10 grams, calculated as silver, per square meter.

Various anti-fogging agents or photographic stabilizers can be used conjointly in the present invention. For example, use can be made of the azoles and azaindenes disclosed on pages 24–35 of RD 17643 (1978), the nitrogen containing carboxylic acids and phosphoric acids disclosed in JP-A-59-168442, the mercapto compounds and their metal salts disclosed in JP-A-59-111636 and the acetylene compounds disclosed in JP-A-62-87957.

The use of a hydrophilic binder for the binder in the structural layers of the photosensitive materials and dye fixing materials is preferred. Examples include those disclosed on pages 26–28 of JP-A-62-253159. In practical terms, transparent or semi-transparent hydrophilic binders are preferred, and examples of these include proteins such as gelatin and gelatin derivatives, and other natural compounds such as cellulose derivatives and polysaccharides such as starch, gum arabic, dextran and pullulan for example, and poly(vinyl alcohol), polyvinylpyrrolidone, acrylamide polymers and other synthetic polymeric compounds. Furthermore, the highly water absorbent polymers disclosed in JP-A-62-245260, which is to say homopolymers of vinyl monomers which have a —COOM group or an —$SO_3M$ group (where M represents a hydrogen atom or an alkali metal) or copolymers of these vinyl monomers or copolymers of these vinyl monomers with other vinyl monomers (for example, sodium methacrylate, ammonium methacrylate, Sumikagel L-5H® made by the Sumitomo Chemical Co., Ltd.), can also be used. Two or more of these binders can also be used in combination.

In cases where a system in which a trace amount of water is supplied and thermal development is carried out is adopted, it is possible by using the polymers which have a high water up-take described above to achieve a rapid take-up of water. Furthermore, when a polymer which has a high water up-take is used in a dye fixing layer or a protective layer thereof, it is possible to preyent the re-transfer of dye from one dye fixing material to another once transfer has been accomplished.

The coated weight of binder in the present invention is preferably not more than 20 grams per square meter, more desirably it is not more than 10 grams per square meter, and most desirably it is not more than 7 grams per square meter Various polymer latexes can be included in the structural layers (including the backing layers) of a photosensitive material or dye fixing material with a view to improving film properties, for example providing dimensional stability, preventing the occurrence of curl, preventing the occurrence of sticking, preventing the formation of cracks in the film and preventing the occurrence of pressure sensitization or desensitization. Examples include all of the polymer latexes disclosed, for example, in JP-A-62-245258, JP-A-62-136648 and JP-A-62-110066. In particular, it is possible to prevent the occurrence of cracking of a mordant layer if a polymer latex which has a low glass transition point (below 40° C.) is used in the mordant layer, and an anti-curl effect can be realized if a polymer latex which has a high glass transition point is used in a backing layer The reducing agents known in the field of heat developable photosensitive materials can be used as the reducing agents which are used in the present invention. Furthermore, the dye providing compounds which have reducing properties described hereinafter can also be included (other reducing agents can also be used conjointly in this case). Furthermore, reducing agent precursors which themselves have no reducing properties but which attain reducing properties as a result of the action of a nucleophilic reagent or heat during the development process can also be used.

Examples of reducing agents which can be used in the present invention include the reducing agents and reducing agent precursors disclosed for example, in columns 49–50 of U.S. Pat. No. 4,500,626, columns 30–31 of U.S. Pat. No. 4,483,914, U.S. Pat. Nos. 4,330,617 and 4,590,152, pages 17–18 of JP-A-60-140335, JP-A-57-

40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256 and pages 78–96 of European Patent 220,746A2.

Combinations of various reducing agents such as those disclosed in U.S. Pat. No. 3,039,869 can also be used.

In cases where a non-diffusible reducing agent is used, combinations with electron transfer agents and/or electron transfer agent precursors can be used in order to promote electron transfer between the nondiffusible reducing agent and the developable silver halide.

Electron transfer agents or precursors thereof can be selected from among the reducing agents and precursors thereof described earlier. The electron transfer agent or precursor thereof preferably has a higher mobility than the non-diffusible reducing agent (electron donor). 1-Phenyl-3-pyrazolidones and aminophenols are especially useful electron transfer agents.

The non-diffusible reducing agents (electron donors) which are used in combination with the electron transfer agents should be those from among the aforementioned reducing agents which are essentially immobile in the layers of the photosensitive material. Preferred examples include hydroquinones, sulfonamidophenols, sulfonamidonaphthols, the compounds disclosed as electron donors in JP-A-53-110827 and the dye providing compounds which have reducing properties but which are fast to diffusion as described hereinafter.

The amount of reducing agent added in the present invention is from 0.001 to 20 mol, and most desirably from 0.01 to 10 mol, per mol of silver.

Silver can be used as the image forming substance in the present invention. Furthermore, compounds which generate or release mobile dyes in accordance with the reaction or in counter-accordance with the reaction when silver ion is reduced to silver at high temperatures, which is to say dye providing compounds, can also be included.

Examples of dye providing compounds which can be used in the present invention include the compounds (couplers) which form dyes by means of an oxidative coupling reaction. These couplers may be four-equivalent couplers or two-equivalent couplers Furthermore, two-equivalent couplers which have a non-diffusible group as a split-off group and form diffusible dyes by means of an oxidative coupling reaction are preferred The non diffusible group may take the form of a polymer chain. Examples of color developing agents and couplers have been described in detail in, for example, *The Theory of the Photographic Process,* by T. H. James, fourth edition, pages 291–334 and 354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Furthermore, compounds which have the function of imagewise releasing or dispersing diffusible dyes can be cited as another type of dye providing compound. Compounds of this type can be represented by formula [LI] indicated below.

$$(\text{Dye-Y})_n\text{-Z} \qquad [\text{LI}]$$

In this formula, Dye represents a dye group which has been temporarily shifted to the short wave length side or a dye precursor group; Y represents a simple bond or a linking group; Z represents a group which produces a difference in the diffusibility of the compound represented by $(\text{Dye-Y})_n$-Z, or which releases Dye and produces a difference in the diffusibilities of the released Dye and $(\text{Dye-Y})_n$-Z, in accordance or in counter-accordance with the photosensitive silver salt which imagewise has a latent image; and n represents 1 or 2. When n is 2, the two Dye-Y moieties may be the same or different.

Examples of dye providing compounds which can be represented by formula [LI] include the compounds described under the headings (1) to (5) below. Moreover, the compounds described under the headings (1) to (3) below form diffusible dye images in counter-accordance with the development of the silver halide (positive dye images), and those described under the headings (4) and (5) form diffusible dye images in accordance with the development of the silver halide (negative dye images).

(1) Dye developing agents in which a dye component is connected with a hydroquinone based developing agent as disclosed, for example, in U.S. Pat. Nos. 3,134,764, 3,362,819, 3,597,200, 3,544,545 and 3,482,972. These dye developing agents are diffusible under alkaline conditions but are rendered fast to diffusion on reaction with silver halide.

(2) Non-diffusible compounds which release diffusible dyes under alkaline conditions but which lose this ability on reaction with silver halide as disclosed, for example, in U.S. Pat. No. 4,503,137 can also be used. Examples include the compounds which release diffusible dyes by means of an intramolecular nucleophilic displacement reaction disclosed, for example, in U.S. Pat. No. 3,980,479 and the compounds which release diffusible dyes by means of an intramolecular winding change reaction of an isoxazolone ring disclosed, for example, in U.S. Pat. No. 4,199,354.

(3) Non-diffusible compounds which react with reducing agents which remain non-oxidized by development and release diffusible dyes as disclosed, for example, in U.S. Pat. No. 4,559,290, European Patent 220,746A2, U.S. Pat. No. 4,783,396 and Kokai Giho 87-6199, can also be used.

Examples include compounds which release diffusible dyes by means of an intramolecular nucleophilic displacement reaction after reduction disclosed, for example, in U.S. Pat. Nos. 4,139,389 and 4,139,379, JP-A-59-185333 and JP-A-57-84453, compounds which release diffusible dyes by means of an intramolecular electron transfer reaction after reduction disclosed, for example, in U.S. Pat. No. 4,232,107, JP-A-59-101649, JP-A-61-88257 and RD 24025 (1984), compounds which release a diffusible dye via single bond cleavage after reduction disclosed, for example, in German Patent 3,008,588A, JP-A-56-142530 and U.S. Pat. Nos. 4,343,893 and 4,619,884, nitro compounds which release diffusible dyes after accepting an electron disclosed, for example, in U.S. Pat. No. 4,450,223, and compounds which release diffusible dyes after accepting an electron disclosed, for example, in U.S. Pat. No. 4,609,610.

Furthermore, compounds which have electron withdrawing groups and N—X bonds (where X represents an oxygen, sulfur or nitrogen atom) within the molecule disclosed, for example, in European Patent 220,746A2, Kokai Giho 87-6199, U.S. Pat. No. 4,783,396, JP-A-63-201653 and JP-A-63-201654, compounds which have electron withdrawing groups and $SO_2$—X bonds (where X has the same meaning as described above) within the molecule disclosed in JP-A-1-26842, compounds which have electron withdrawing groups and PO—X bonds (where X has the same significance as described above) within the molecule disclosed in JP-A-63-271344, and compounds which have electron withdrawing groups and C—X' bonds (where X' is the same as X or —$SO_2$—) disclosed in JP-A-63-271341 are more desirable. Furthermore, compounds which release diffusible dyes on the cleavage of a single bond after reduction by means of a $\pi$-bond which is conjugated with an electron withdrawing group disclosed in JP-A-1-161237 and JP-A-1-161342 can also be used.

Among these compounds, those which have electron withdrawing groups and an N—X bonds within the molecule are especially desirable. Examples include compounds (1)–(3), (7)–(10), (12), (13), (15), (23)–(26), (31), (32), (35), (36), (40), (41), (44), (53)–(59), (64) and (70) disclosed in U.S. Pat. No. 4,783,396 or European Patent 220,746A2, and compounds (11)–(23) disclosed in Kokai Giho 87-1699.

(4) Compounds which release diffusible dyes by means of a reaction with the oxidized form of a reducing agent, being couplers which have a diffusible dye as a split-off group (DDR couplers). Examples include those disclosed in British Patent 1,330,524, JP-B-48-39165 and U.S. Pat. Nos. 3,443,940, 4,474,867 and 4,483,914. (The term "JP-B" as used herein signifies an "examined Japanese patent publication".)

(5) Compounds which are reducing with respect to silver halides or organic silver salts and which release diffusible dyes on reduction (DRR compounds). Other reducing agents cannot be used with these compounds, and so there are problems with image staining due to oxidative degradation of the reducing agent and this is undesirable. Examples have been disclosed, for example, in U.S. Pat. Nos. 3,928,312, 4,053,312, 4,055,428 and 4,336,322, JP-A-59-65839, JP-A-59-69839, JP-A-53-3819, JP-A-51 104343, RD 17465, U.S. Pat. Nos. 3,725,062, 3,728,113 and 3,443,939, JP-A-58-116537, JP-A-57-179840 and U.S. Pat. No. 4,500,626. The compounds disclosed in columns 22 to 44 of the aforementioned U.S. Pat. No. 4,500,626 can be cited as examples of DRR compounds. Of these, compounds (1)–(3), (10)–(13), (16)–(19), (28)–(30), (33)–(35), (38)–(40) and (42)–(64) disclosed in the aforementioned U.S. patent, are preferred. Furthermore, the compounds disclosed in columns 37–39 of U.S. Pat. No. 4,639,408 are also of use.

Furthermore, the dye-silver compounds in which a dye is bonded to an organic silver salt (*Research Disclosure,* May 1978, pages 54–58 for example), the azo dyes which are used in the heat developable silver dye bleach method (U.S. Pat. No. 4,235,957, *Research Disclosure,* April 1976, pages 30–32 for example) and leuco dyes (U.S. Pat. Nos. 3,985,565 and 4,022,617 for example) can also be used as dye providing compounds, as an alternative to the couplers and compounds of formula [LI] described above.

The compounds represented by formulae [I], [II] and [III] of the present invention are especially effective in heat developable photosensitive materials which comprise a support having thereon a photosensitive silver halide, a binder, an electron transfer agent or a precursor thereof, an electron donor or a precursor thereof, and a reducible dye providing compound which releases a diffusible dye on reduction.

Embodiments are described in further detail below. The reducible dye providing compounds which are used in the present invention are compounds which can be represented by formula [CI] indicated below.

$$\text{PWR-(Time)}_t\text{-Dye} \qquad [CI]$$

In this formula, PWR is a group which releases -(Time)$_t$-Dye on reduction.

Time represents a group which releases Dye via a reaction following release as -(Time)$_t$-Dye.

Moreover, t represents an integer of 0 or 1.

Dye represents a dye or a dye precursor.

PWR will more be described in detail.

PWR may be a moiety which contains an electron accepting center and an intramolecular nucleophilic displacement reaction center in a compound which releases a photographically useful reagent by means of an intramolecular displacement reaction after being reduced, as disclosed in U.S. Pat. Nos. 4,139,389, 4,139,379 and 4,564,577, JP-A-59-185333 and JP-A-57-84453, or it may be a moiety which contains an electron accepting quinoid center and a carbon atom by which this quinoid center is linked to a photographically useful reagent in a compound which eliminates the photographically useful reagent by means of an intramolecular electron transfer reaction after reduction, as disclosed in U.S. Pat. No. 4,232,107, JP-A-59-101649, *Research Disclosure* (1984) IV, 24025 or JP-A-61-88257. Furthermore, it may be a moiety which contains an aryl group which is substituted with electron attracting groups and the atom (sulfur, carbon or nitrogen atom) by which this aryl group is linked to a photographically useful reagent in a compound which releases the photographically useful reagent on cleavage of a single bond after reduction as disclosed in JP-A-56-142530 and U.S. Pat. Nos. 4,343,893 and 4,619,884. Furthermore, it may be a moiety which contains a nitro group and a carbon atom by which this nitro group is linked to a photographically useful reagent in a nitro compound which releases the photographically useful reagent after accepting an electron, as disclosed in U.S. Pat. No. 4,450,223. Furthermore, it may be a moiety which contains a geminal dinitro part and a carbon atom by which this dinitro part is linked to a photographically useful reagent in a dinitro compound with which the photographically useful reagent is $\beta$-eliminated after electron acceptance as disclosed in U.S. Pat. No. 4,609,610.

Furthermore, compounds which have an electron withdrawing group and an N—X bond (where X represents an oxygen, sulfur or nitrogen atom) within the molecule as disclosed, for example, in European Patent 220,746A2, Kokai Giho 87-6199, U.S. Pat. No. 4,783,396, JP-A-63-201653 and JP-A-63-201654, compounds which have an electron withdrawing group and an $SO_2$—X bond (where X has the same meaning as described above) in the molecule as disclosed in JP-A-1-26842, compounds which have an electron withdrawing group and a PO—X bond (where X has the same meaning as described above) within the molecule as disclosed in JP-A-63-271344, and compounds which have an electron withdrawing group and a C–X' bond (where X' has the same meaning as X or represents —$SO_2$—) within the molecule as disclosed in JP-A-63-271341 can be used as the PWR moiety. Furthermore, the compounds which release diffusible dyes on cleavage of a single bond after reduction by means of a $\pi$-bond which is conjugated with an electron accepting group disclosed in JP-A-1-161237 and JP-1-161342 can also be used.

Those compounds of formula [CI] which can be represented by formula [CII] are preferred for more adequately realizing the aims of the present invention.

[CII]

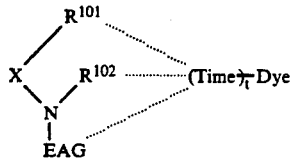

(Time)$_t$-Dye is bonded to either $R^{101}$, $R^{102}$ or EAG.

In formula [CII],

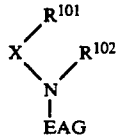

corresponds to PWR.

X represents an oxygen atom (—O—), a sulfur atom (—S—) or a group which contains a nitrogen atom (—N($R^{103}$)—).

$R^{101}$, $R^{102}$ and $R^{103}$ represent groups other than hydrogen atoms or simple bonds.

The groups other than hydrogen atom represented by $R^{101}$, $R^{102}$ and $R^{103}$ are alkyl groups, aralkyl groups, alkenyl groups, alkynyl groups, aryl groups, heterocyclic groups, sulfonyl groups, carbamoyl groups, or sulfamoyl groups for example. These groups may have substituent groups.

$R^{101}$ and $R^{103}$ are preferably substituted or unsubstituted alkyl groups, alkenyl groups, alkynyl groups, aryl groups, heterocyclic groups, acyl groups or sulfonyl groups for example. $R^{101}$ and $R^{103}$ preferably have from 1 to 40 carbon atoms.

$R^{102}$ is preferably a substituted or unsubstituted acyl group or a sulfonyl group. For example, the same acyl groups and sulfonyl groups as described for $R^{101}$ and $R^{103}$ can be employed. It preferably has from 1 to 40 carbon atoms.

$R^{101}$, $R^{102}$ and $R^{103}$ may be joined together to form from five to eight membered rings.

X is most desirably oxygen.

EAG represents a group which accepts an electron from a reducing substance, and it is bonded to a nitrogen atom. Groups which can be represented by formula [A] are preferred for EAG.

[A]

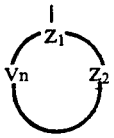

In formula [A], $Z_1$ represents

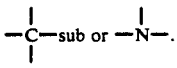

$V_n$ represents a group of atoms which, together with $Z_1$ and $Z_2$, forms a three to eight membered aromatic group, and n is an integer of from three to eight.

$V_3$ is $—Z_3—$, $V_4$ is $—Z_3—Z_4—$, $V_5$ is $—Z_3—Z_4—Z_5—$, $V_6$ is $—Z_3—Z_4—Z_5—Z_6—$, $V_7$ is $—Z_3—Z_4—Z_5—Z_6—Z_7—$, and $V_8$ is $—Z_3—Z_4—Z_5—Z_6—Z_7—Z_8—$.

$Z_2$ to $Z_8$ each represent

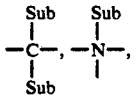

—O—, —S— or —$SO_2$—, and Sub represents a simple bond ($\pi$-bond), a hydrogen atom or a substituent group as described below. The Sub groups may be the same or different, or they may be joined together to form from three to eight membered saturated or unsaturated carbocyclic or heterocyclic rings.

Sub is selected so that the sum of the Hammett substituent constants $\sigma_p$ of the substituent groups in formula [A] is at least +0.50, preferably at least 0.70, and most desirably at least +0.85.

EAG is preferably a heterocyclic group or an aryl group which is substituted with at least one electron withdrawing group. The substituent groups which are bonded to the aryl group of the heterocyclic group of EAG can be used to adjust the properties of the compound as a whole. Examples of the properties of the compound as a whole which can be adjusted include, in addition to the ease with which an electron is accepted, water solubility, oil solubility, diffusibility, sublimability, melting point, dispersibility in binders such as gelatin, reactivity with nucleophilic groups, and reactivity with electrophilic groups.

Examples of EAG have been described on pages 6 and 7 of European Patent 220,746A2.

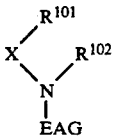

in formula [CII] has the function of releasing (Time)$_t$—Dye on being triggered by the cleavage of the N—X bond as a result of EAG accepting an electron (being reduced).

Time represents a group which releases Dye via a subsequent reaction with cleavage of the nitrogen—oxygen, nitrogen—nitrogen or nitrogen—sulfur bond being a trigger.

Various groups which can be represented by Time are known, and examples include the groups disclosed on pages 5 and 6 of JP-A-61-147244, on pages 8 to 14 of JP-A-61-236549, and pages 36 to 44 of JP-A-62-215270.

The dye represented by Dye is, for example, an azo dye, an azomethine dye, an anthraquinone dye, a naphthoquinone dye, a styryl dye, a nitro dye, a quinoline dye, a carbonyl dye or a phthalocyanine dye. Moreover, these dyes can be used in a form which is temporarily shifted to the short wavelength side of which the color can be restored during development.

In practice, the Dye groups disclosed in European Patent 76,492A and JP-A-59-165054 can be used.

The compounds represented by the above mentioned formula [CII] must themselves be immobile in the photographic layer. For this reason, ballast groups which have at least 8 carbon atoms are desirable at the EAG, $R^{101}$, $R^{102}$, $R^{103}$ or X positions (and especially at the EAG position)

Examples of the reducible dye providing compounds which can be used in the present invention are indicated below, but the invention is not limited to these examples, and the dye providing compounds described, for example, in European Patent 220,746A2 and Kokai Giho 87-6199 can also be used.

(1)

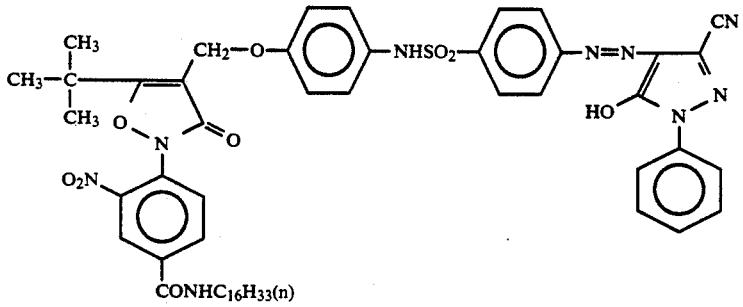

(2)

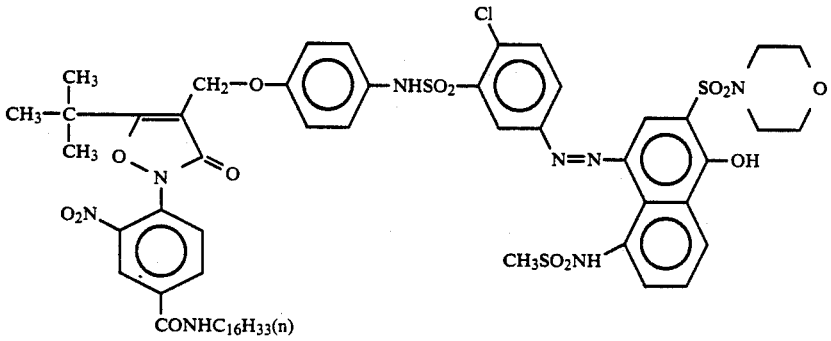

(3)

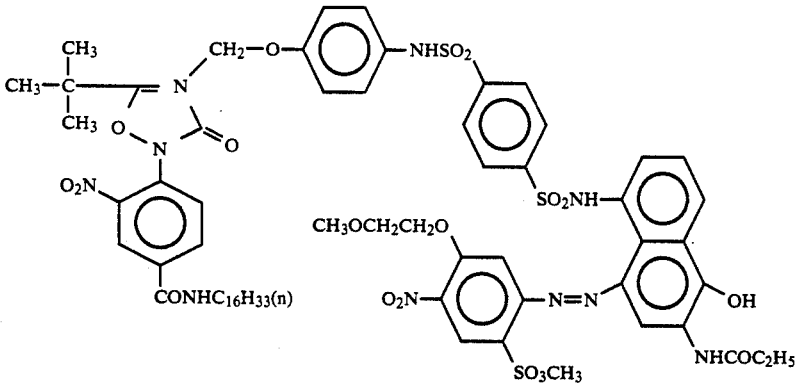

(4)

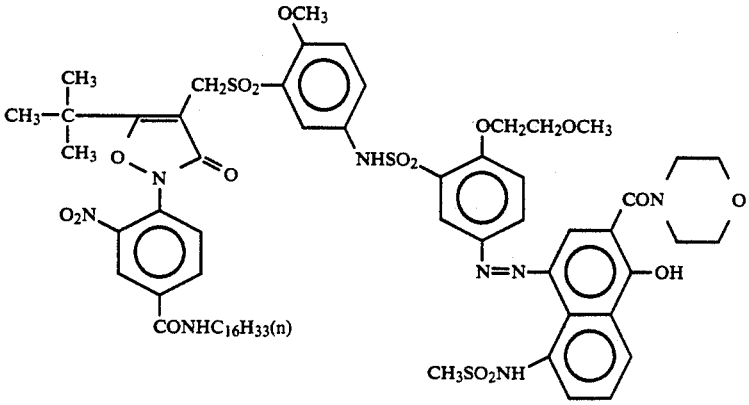

-continued
(5)
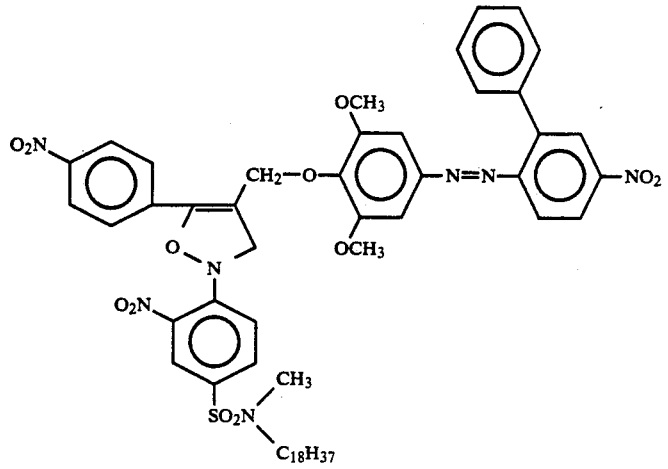
(6)
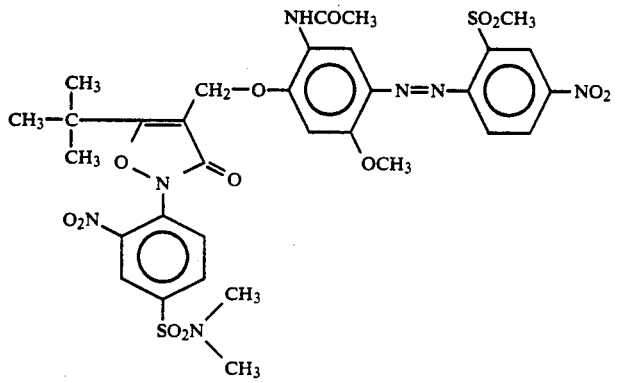
(7)
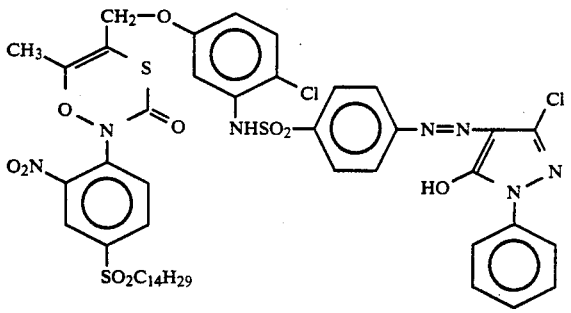
(8)
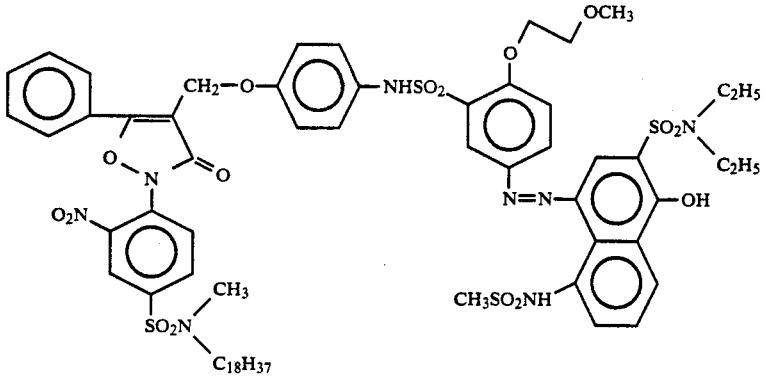

-continued
(9)
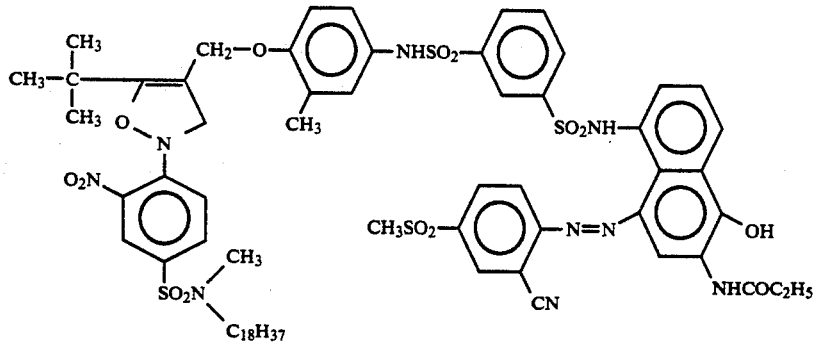
(10)
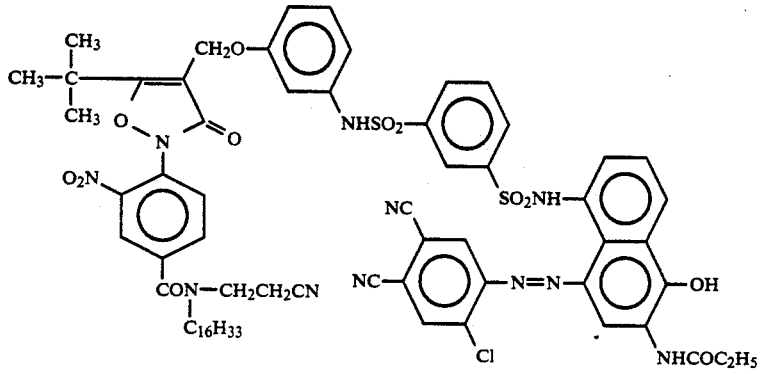
(11)
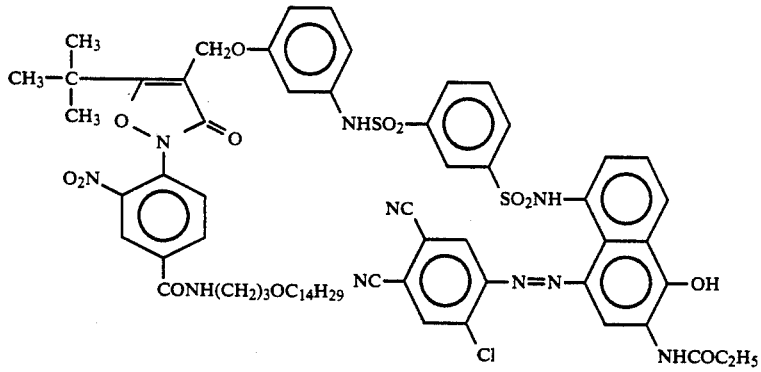
(12)
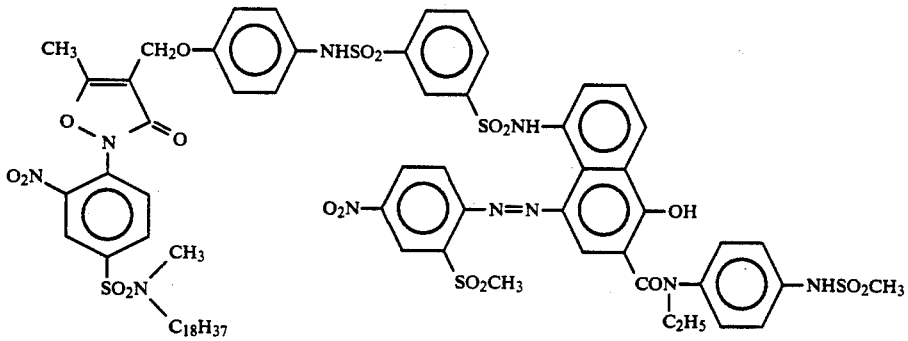
(13)
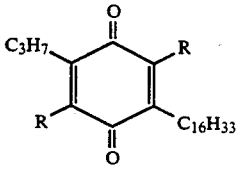
R:

-continued
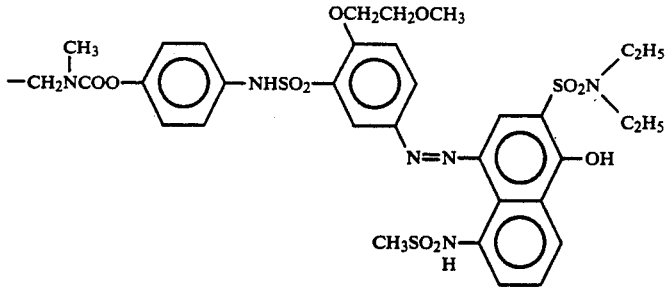
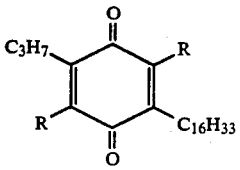
(14)
R;
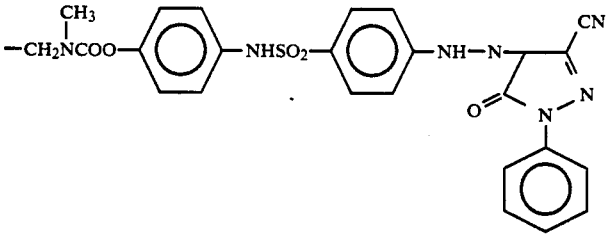
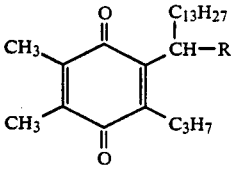
(15)
R:
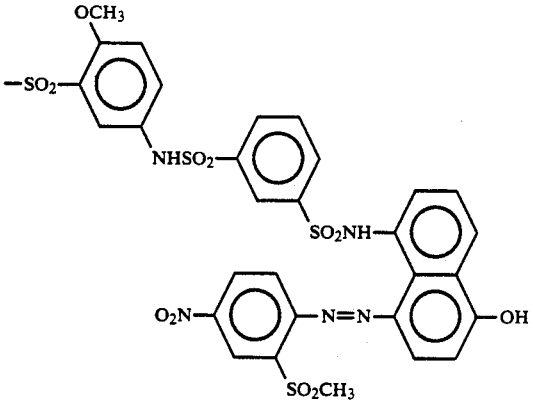

-continued (16)

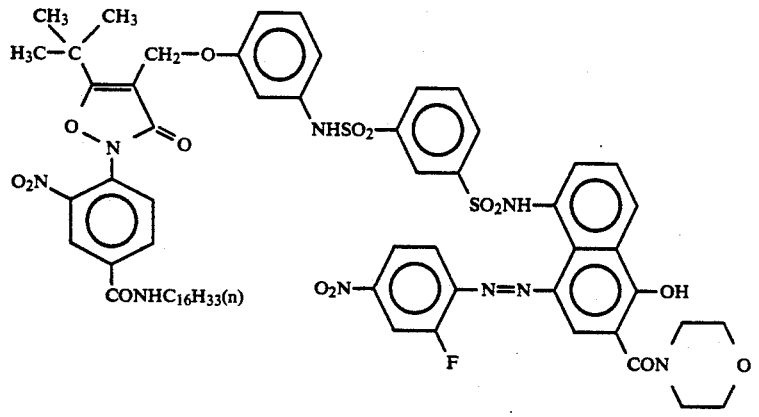

These compounds can be prepared using the methods disclosed in the aforementioned patent specifications.

The amount of dye providing compound of formula [CI] used depends on the extinction coefficient of the dye but is within the range from 0.05 to 5 mmol/m$^2$, and preferably within the range from 0.1 to 3 mmol/m$^2$. Dye providing substances can be used individually, or combinations of two or more such substances can be used. Furthermore, mixtures of at least one cyan, one magenta and one yellow dye providing substances, or mixtures of two or more dye providing substances which release diffusible dyes which have different hues, can be used in the layer which contains the silver halide or in a layer adjacent thereto, as disclosed in JP-A-60-162251, to obtain black or different colored images.

Electron donors and electron transfer agents (ETA) are used in the present invention, and details of these compounds have been disclosed, for example, in European Patent 220,746A2 and Kokai Giho 87-6199. The compounds represented by formula [C] or [D] below are especially desirable as electron donors (or precursors thereof).

[C]

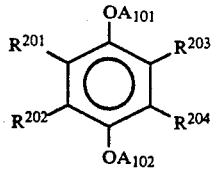

[D]

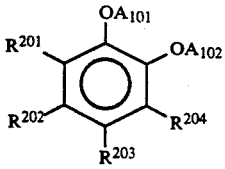

In these formulae, $A_{101}$ and $A_{102}$ each represents a hydrogen atom or a protective group of a deprotectable phenolic hydroxyl group which can be removed by means of a nucleophilic reagent.

Here, a nucleophilic reagent is an anionic reagent such as $OH^-$, $RO^-$ (where R represents an alkyl group or an aryl group), a hydroxamic acid anion or $SO_3^{2-}$ for example, or a compound which has a pair of non-covalent electrons, such as primary or secondary amines, hydrazine, hydroxylamines, alcohols and thiols for example.

Preferred examples of $A_{101}$ and $A_{102}$ include hydrogen atoms, acyl groups, alkylsulfonyl groups, arylsulfonyl groups, alkoxycarbonyl groups, aryloxycarbonyl groups, dialkylphosphoryl groups, diarylphosphoryl groups and the protective groups disclosed in JP-A 59-197037 and JP-A-59-20105. In those cases where it is possible, $A_{101}$ and $A_{102}$ may be joined to $R^{201}$, $R^{202}$,$R^{203}$ and $R^{204}$ to form rings Furthermore, $A_{102}$ and $A_{102}$ may be joined together to form a ring.

$R^{201}$, $R^{202}$, $R^{203}$ and $R^{204}$ each represents, for example, a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group. These groups may have substituent groups where this is possible.

However, the total number of carbon atoms of $R^{201}$ to $R^{204}$ is at least 8. Furthermore, $R^{201}$ and $R^{202}$ and/or $R^{203}$ and $R^{204}$ in formula [C], and $R^{201}$ and $R^{202}$, $R^{202}$ and $R^{203}$, and/or $R^{203}$ and $R^{204}$ in formula [D] may be joined together to form saturated or unsaturated rings Those electron donors represented by the aforementioned formula [C] or [D] in which at least two of $R^{201}$ to $R^{204}$ are substituent groups other than hydrogen atoms are preferred. In the most desirable compounds at least one of $R^{201}$ and $R^{202}$, and at least one of $R^{203}$ and $R^{204}$ is a substituent group other than a hydrogen atom.

A plurality of electron donors can be used conjointly, and electron donors and their precursors may be used conjointly.

Examples of electron donors are indicated below, but they are not limited to these compounds.

(ED-1)

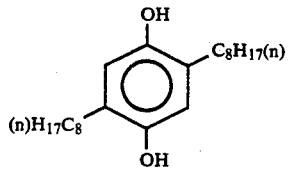

(ED-2)

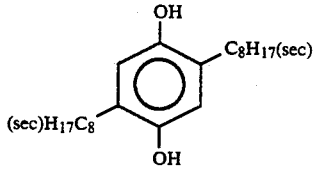

-continued (ED-3)

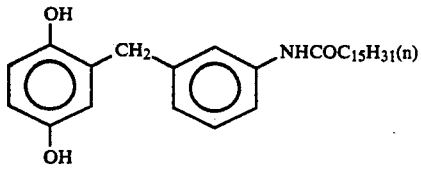

(ED-4)

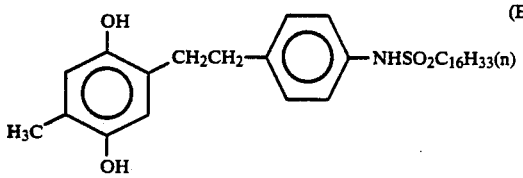

(ED-5)

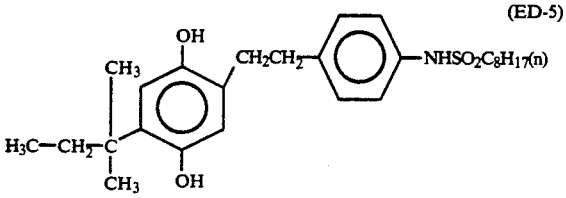

(ED-6)

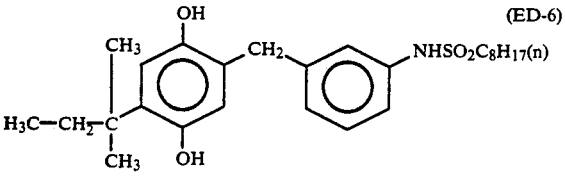

(ED-7)

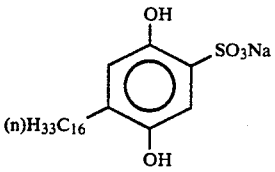

(ED-8)

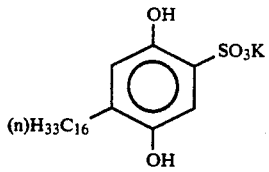

(ED-9)

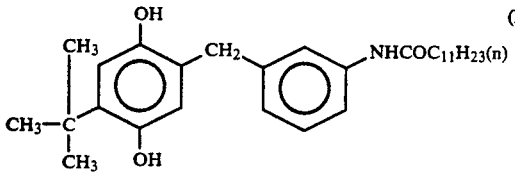

(ED-10)

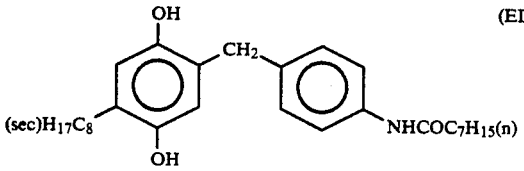

-continued (ED-11)

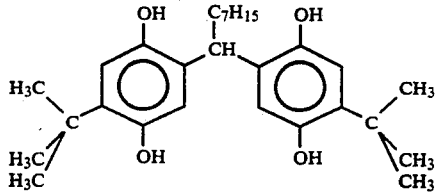

(ED-12)

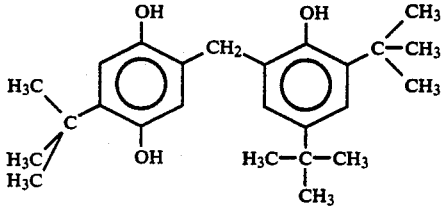

(ED-13)

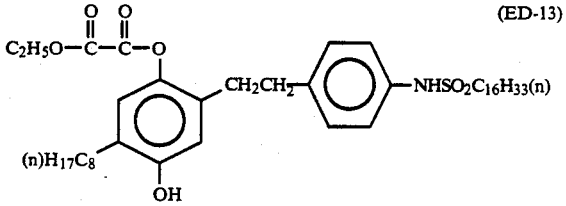

(ED-14)

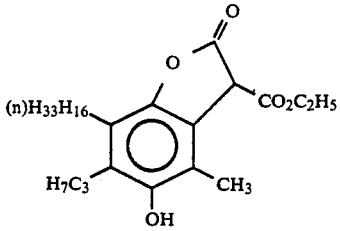

The amount of the electron donor (or precursor thereof) used lies within a wide range, but it is preferably within the range from 0.01 mol to 50 mol, and most desirably within the range of from 0.1 mol to 5 mol, per mol of positive dye providing substance. Furthermore, the amount is from 0.001 mol to 5 mol, and preferably from 0.01 mol to 1.5 mol, per mol of silver halide.

Any ETA, provided that it is a compound which is oxidized by silver halide and of which the oxidized form has the ability to undergo cross-oxidation with the above mentioned electron donors, can be used as the ETA which is used in combination with these electron donors, but mobile ETA are preferred.

The compounds represented by formulae [X-I] and [X-II] indicated below are especially desirable ETA.

[X-I]

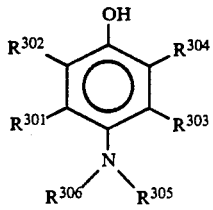

-continued

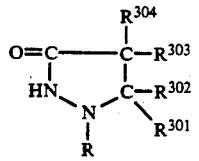

[X-II]

R in formula [X-II] represents an aryl group. $R^{301}$, $R^{302}$, $R^{304}$, $R^{305}$ and $R^{306}$ in formulae [X-I] and [X-II] represent hydrogen atoms, halogen atoms, acylamino groups, alkoxy groups, alkylthio groups, alkyl groups or aryl groups, and these may be substituted where this is possible Furthermore, these groups may be the same or different.

The compounds which can be represented by formula [X-II] are especially desirable in the present invention. In formula [X-II], $R^{301}$, $R^{302}$, $R^{303}$ and $R^{304}$ are preferably hydrogen atoms, alkyl groups which have from 1 to 10 carbon atoms, substituted alkyl groups which have from 1 to 10 carbon atoms or substituted or unsubstituted aryl groups. These groups are most desirably hydrogen atoms, methyl groups, hydroxymethyl groups, phenyl groups or phenyl groups which are substituted with hydrophilic groups such as hydroxyl group, alkoxy groups, sulfo group and carboxyl group for example.

Examples of ETA are indicated below.

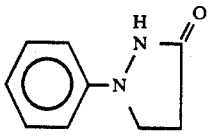

(X-1)

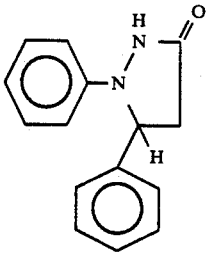

(X-2)

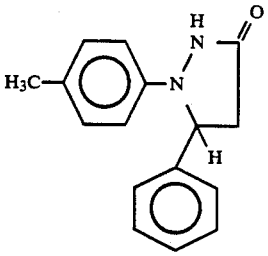

(X-3)

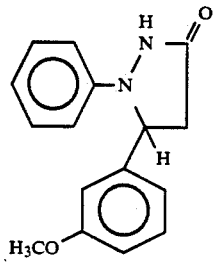

(X-4)

-continued

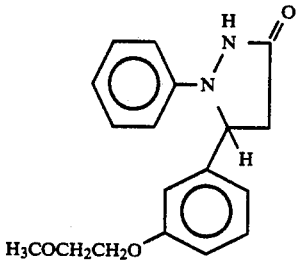

(X-5)

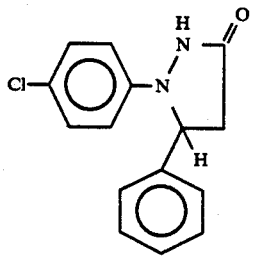

(X-6)

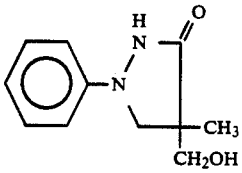

(X-7)

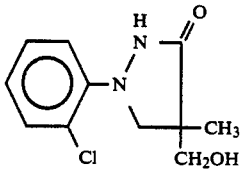

(X-8)

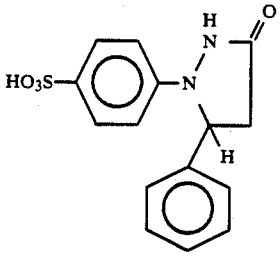

(X-9)

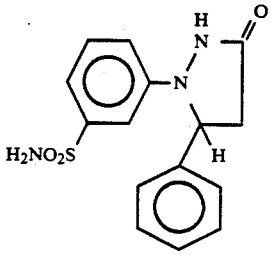

(X-10)

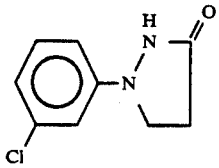

(X-11)

-continued (X-12)

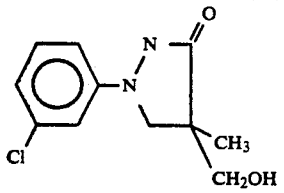

(X-13)

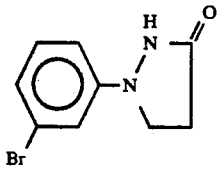

(X-14)

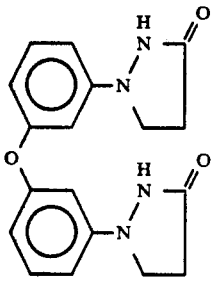

(X-15)

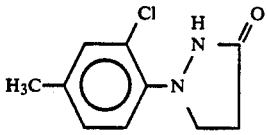

(X-16)

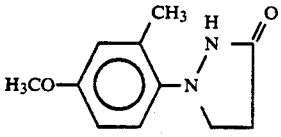

(X-17)

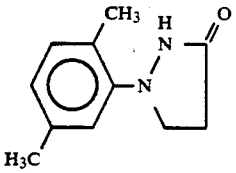

The ETA precursors which are used in the present invention are compounds which have no developing action during the storage of the photosensitive materials prior to use, but which can release ETA initially by the action of a suitable activating agent (for example a base or a nucleophilic agent) or as a result of heat.

In particular, the ETA precursors which are used in the present invention have no function as an ETA before development because the reactive functional group of the ETA is blocked by a blocking group, but they can function as ETA under alkaline conditions or on heating because the blocking group is cleaved.

The ETA precursors which are used in the present invention include, for example, 2- and 3-acyl derivatives or 2-aminoalkyl or hydroxyalkyl derivatives of 1-phenyl- 3-pyrazolidone, metal salts of hydroquinone and catechol (for example the lead salts, cadmium salts, calcium salts, barium salts), halo-acyl derivatives of hydroquinone, oxazine or bisoxazine derivatives of hydroquinone, lactone type ETA precursors, hydroquinone precursors which have quaternary ammonium groups, cyclohexa-2-ene-1,4-dione type compounds, compounds which release ETA by means of an electron transfer reaction, compounds which release ETA by means of an intramolecular nucleophilic displacement reaction, ETA precursors which are blocked with a phthalide group, and ETA precursors which are blocked with an indomethyl group.

The ETA precursors which can be used in the present invention are known compounds. For example, use can be made of the developing agent precursors disclosed, for example, in U.S. Pat. Nos. 3,241,967, 3,246,988, 3,295,978, 3,462,266, 3,586,506. 3,615,439, 3,650,749, 4,209,580, 4,330,617 and 4,310,612, British Patents 1,023,701, 1,231,830, 1,258,924 and 1,346,920, JP-A-57-40245, JP-A-58-1139, JP-A-58-1140, JP-A-59-178458, JP-A-59-182449 and JP-A-59-182450.

The precursors of 1-phenyl-3-pyrazolidones disclosed, for example, in JP-A-59-178458, JP-A-59-182449 and JP-A-59-182450 are especially desirable ETA and ETA precursors can be used conjointly.

Combinations of an electron donor and an ETA are preferably incorporated into the heat developable color photosensitive material of the present invention. Combinations of two or more of electron donor, ETA or precursors thereof respectively can be used. They may be added to each of the emulsion layers (blue sensitive layer, green sensitive layer, red sensitive layer, infrared sensitive layer, ultraviolet sensitive layer, etc.) of a photosensitive material, or to just some of the emulsion layers, they may be added to layers adjacent to the emulsion layers (anti-halation layers, subbing layers, interlayers, protective layers, etc.), or they may be added to all of the layers. The electron donor and ETA can be added to the same layer or to separate layers. Furthermore, these reducing agents may be added to the same layer as a dye providing substance, or they may be added to a different layer. But a nondiffusible electron donor is preferably included in the same layer as the dye providing substance. The ETA can be incorporated into the image receiving material (dye fixing layer), and in cases where a trace amount of water is present at the time of thermal development it may be dissolved in this water. The preferred amount of electron donor, ETA or precursors thereof used is a total of from 0.01 to 50 mol, and preferably of from 0.1 to 5 mol per mol of dye providing compound, and a total amount of from 0.001 to 5 mol, and preferably from 0.01 to 1.5 mol, per mol of silver halide.

Furthermore, the ETA accounts for not more than 60 mol%, and preferably not more than 40 mol%, of the total amount of reducing agents. In those cases where the ETA is dissolved in water and supplied as a solution, the concentration of ETA is preferably from 10-4 mol/liter to 1 mol/liter.

The hydrophobic additives such as the dye providing compounds and non-diffusible reducing agents for example can be introduced into the layers of the photosensitive material using known methods such as those described, for example, in U.S. Patent 2,322,027. In this case, high boiling point organic solvents such as those disclosed, for example in JP-A-59-83154, JP-A-59-178451, JP-A-59-178452, JP-A-59-178453, JP-A-178454, JP-A-59-178455 and JP-A-59-178457 can be used conjointly with low boiling point organic solvents having a boiling point from 50° C. to 160° C., as required.

The amount of high boiling point organic solvent is not more than 10 grams, and preferably not more than 5 grams, per gram of dye providing compound used Furthermore, they are suitably used in amounts of not more than 1 cc, preferably not more than 0.5 cc, and most desirably of not more than 0.3 cc, per gram of binder.

The methods of dispersion with polymers disclosed in JP-B-51-39853 and JP-A-51-59943 can also be used.

In the case of compounds which are essentially insoluble in water, the compounds can be included by dispersion as fine particles in the binder as well as by using the method described above.

Various surfactants can be used when hydrophobic compounds are being dispersed in a hydrophilic colloid. For example, use can be made of the surfactants disclosed on pages 37–38 of JP-A-59-157636.

Compounds which activate development and at the same time stabilize the image can be used in a photosensitive material in the present invention. Examples of compounds of which are preferred have been disclosed in columns 51–52 of U.S. Patent 4,500,626.

In a system where the image is formed by dye diffusion transfer, a dye fixing material is used along with the photosensitive material The dye fixing material may be coated separately on a separate support from the photosensitive material, or it may be coated on the same support as the photosensitive material. The relationships disclosed in column 57 of U.S. Pat. No. 4,500,626 can also be used here in respect of the relationship between the photosensitive material and the dye fixing material and the relationship with the support and the relationship with a white reflecting layer.

The dye fixing materials preferably used in the present invention have at least one layer which contains a mordant and a binder. The mordants known in the field of photography can be used for the mordant. Examples include the mordants disclosed in columns 58–59 of U.S. Pat. No. 4,500,626 and on pages 32–41 of JP-A-61-88256, and those disclosed in JP-A-62-244043 and JP-A-62-244036. Furthermore, polymeric compounds which have dye accepting properties such as those disclosed in U.S. Pat. No. 4,463,079 may be used.

Auxiliary layers, such as protective layers, peeling layers and anti-curl layers for example, can be established, as required, in a dye fixing material The establishment of a protective layer is especially useful.

High boiling point organic solvents can be used as plasticizers, slip agents or as agents for improving the peeling properties of the photosensitive material and the dye fixing material in the structural layers of the photosensitive materials and dye fixing materials. In practice, use can be made of those solvents disclosed, for example, on page 25 of JP-A-62-253159 and JP-A-62-245253.

Moreover, various silicone oils (all of the silicone oils ranging from dimethylsilicone oil to the modified silicone oils in which various organic groups have been introduced into dimethylsiloxane) can be used for the above mentioned purpose. As an example, the various modified silicone oils described in data sheet P6-18B, "Modified Silicone Oils", put out by the Shin-Etsu Silicone Co., Ltd. and especially the carboxy modified silicone (trade name X-22-3710) are effective.

Furthermore, the silicone oils disclosed in JP-A-62-215953 and JP-A-63-46449 are also effective.

Anti-color fading agents may be used in the photosensitive materials and dye fixing materials. Antioxidants, ultraviolet absorbers and certain types of metal complex can be used as anti-color fading agents Examples of compounds which are effective as antioxidants include chroman based compounds, coumaran based compounds, phenol based compounds (for example, hindered phenols), hydroquinone derivatives, hindered amine derivatives, and spiroindane based compounds. Furthermore, the compounds disclosed in JP-A-61-159644 are also effective.

Compounds such as benzotriazole based compounds (for example, U.S. Pat. No. 3,533,794), 4-thiazolidone based compounds (for example, U.S. Pat. No. 3,352,681), benzophenone based compounds (for example, JP-A-46-2784) and the other compounds disclosed, for example, in JP-A-54-48535, JP-A-62-136641 and JP-A-61-88256 can be used as ultraviolet absorbers. Furthermore, the ultraviolet absorbing polymers disclosed in JP-A-62-260152 are also effective.

The compounds disclosed, for example, in U.S. Pat. Nos. 4,241,155, columns 3–36 of U.S. Pat. No. 4,245,018, columns 3–8 of U.S. Pat. No. 4,254,195, JP-A-62-174741, pages 27 29 of JP-A-61-88256, JP-A-63-199248, JP-A-1-75568 and JP-A-1-74272 can be used as metal complexes.

Examples of useful anti-color fading agents have been disclosed on pages 125–137 of JP-A-62-215272.

Anti-color fading agents for preventing the fading of dyes which have been transferred to a dye fixing material may be included beforehand in the dye fixing material, or they may be supplied to the dye fixing material from the outside, from the photosensitive material for example.

The above mentioned antioxidants, ultraviolet absorbers and metal complexes may be used in combinations of each type.

Fluorescent whiteners may be used in the photosensitive materials and dye fixing materials. In particular, fluorescent whiteners are preferably incorporated into the dye fixing material or supplied to the dye fixing material from the outside, from the photosensitive material for example. For instance, the compounds disclosed, for example, in chapter 8 of volume V of *The Chemistry of Synthetic Dyes*, by K. Veenkataraman, and JP-A-61-143752, can be used. In more practical terms, use can be made, for example, of stilbene based compounds, coumarin based compounds, biphenyl based compounds, benzoxazolyl based compounds, naphthalimide based compounds, pyrazoline based compounds and carbostyryl based compounds.

Fluorescent whiteners can be used in combination with anti-color fading agents.

The film hardening agents disclosed, for example, in column 41 of U.S. Pat. No. 4,678,739, JP-A-59-116655, JP-A-62-245261 and JP-A-61-18942 can be used as film hardening agents in the structural layers of the photosensitive materials and dye fixing materials. In more practical terms, use can be made of aldehyde based film hardening agents (formaldehyde for example), aziridine based film hardening agents, epoxy based film hardening agents, vinylsulfone based film hardening agents (N,N'-ethylene-bis(vinylsulfonylacetamido)ethane for example), N-methylol based film hardening agents (dimethylol urea for example), and polymeric film hardening agents (the compounds disclosed, for example, in JP-A-62-234157).

Various surfactants can be used in the structural layers of the photosensitive materials and dye fixing materials as coating promotors, for improving peelability, for improving slip properties, for antistatic purposes or for accelerating development for example. Examples of surfactants have been disclosed, for example, in JP-A-62-173463 and JP-A-62-183457.

Organic fluoro-compounds may be included in the structural layers of the photosensitive materials and dye fixing materials to improve slip properties, for antistatic purposes or for improving peeling properties for example. Typical examples of organic fluorocompounds include the fluorine based surfactants disclosed, for example, in columns 8–17 of JP-B-57-9053, JP-A-61-20944 and JP-A-62-135826, and the oil-like fluorine based compounds such as fluorine oil and hydrophobic fluorine compounds including solid fluorine compound resins such as tetrafluoroethylene resins.

Matting agents can be used in the photosensitive materials and dye fixing materials. In addition to the compounds such as silicon dioxide, polyolefin or polymethacrylate disclosed on page 29 of JP-A-61-88256, the compounds disclosed in JP-A-63-274944 and JP-A-63-274952, such as benzoguanamine resin beads, polycarbonate resin beads and AS resin beads, for example, can be used as matting agents.

Furthermore, thermal solvents, anti-foaming agents, biocides and fungicides, and colloidal silica, for example, may be included in the photosensitive materials and dye fixing materials. Examples of these additives have been disclosed on pages 26–32 of JP-A-61-88256.

Image forming accelerators can be used in the photosensitive materials and/or dye fixing materials of the present invention. Image forming accelerators are compounds which accelerate the redox reaction of the silver salt oxidizing agents and the reducing agent, accelerate the reaction which produces the dye from the dye providing substance or breaks down the dye or releases a diffusible dye, and accelerate the migration of the dye from the photosensitive material layer to the dye fixing layer. On the basis of their physicochemical function, these accelerators can be classified as bases or base precursors, nucleophilic compounds, high boiling point organic solvents (oils), thermal solvents, surfactants, and compounds which interact with silver or silver ion, for example. However, these groups of substances generally have a complex function and normally combine some of the above mentioned accelerating effects. Details have been disclosed in columns 38–40 of U.S. Pat. No. 4,678,739.

Base precursors are, for example, salts of a base and an organic acid which is decarboxylated by heating, or compounds which releases amines by means of an intramolecular nucleophilic displacement reaction, a Lossen rearrangement or a Beckmann rearrangement. Examples have been disclosed, for example, in U.S. Pat. No. 4,511,493 and JP-A-62-65038.

In the systems in which thermal development and dye transfer are carried out simultaneously in the presence of a small amount of water, the base and/or base precursor is preferably included in the dye fixing material to ensure good storage properties for the photosensitive material.

Apart from the above, the combinations of sparingly soluble metal compounds and compounds which can take part in a complex forming reaction (known as complex forming compounds) with the metal ions from which these sparingly soluble metal compounds are formed disclosed in European Patent 210,660A and U.S. Pat. No. 4,740,445. Compounds which produce bases by electrolysis disclosed in JP-A-61-232451, for example, can also be used as base precursors. The former compounds are particularly effective. The sparingly soluble metal compound and the complex forming compound are usefully added separately to the photosensitive material and the dye fixing material.

Various development terminating agents can be used in the photosensitive materials and/or dye fixing materials of the present invention to obtain a constant image, irrespective of fluctuations of the processing temperature and the processing time during development.

Here, the term "development terminator" signifies a compound which, after proper development, neutralizes the base rapidly or reacts with the base, reduces the base concentration in the film and terminates development, or a compound which interacts with silver and silver salts and inhibits development. In practice, these compounds include acid precursors which release acids on heating, electrophilic compounds which undergo displacement reactions with the base which is present on heating, and nitrogen containing heterocyclic compounds, mercapto compounds and precursors of these compounds. Further details have been disclosed on pages 31–32 of JP-A-62-253159.

Supports which can withstand the processing temperature can be used for the supports for the photosensitive materials and dye fixing materials of the present invention. Paper and synthetic polymers (films) are generally used. In practice, use can be made of supports comprised of poly(ethylene terephthalate), polycarbonate, poly(vinyl chloride), polystyrene, polypropylene, polyimide, cellulose derivatives (for example, triacetyl cellulose) or supports wherein a pigment such as titanium oxide is included within these films, film type synthetic papers made from polypropylene, papers made from pulp of a synthetic resin such as polyethylene and natural pulp, Yankee paper, baryta paper, coated papers (especially cast coated papers), metals, cloths and glasses for example.

These supports can be used individually, or supports which have been laminated on one side or on both sides with a synthetic polymer such as polyethylene for example can also be used.

The supports disclosed on pages 29–31 of JP-A-62-253159 can also be used.

A hydrophilic binder and a semiconductive metal oxide such as tin oxide or alumina sol, carbon black and other anti-static agents may be coated on the surfaces of these supports.

The methods which can be used for exposing and recording an image on the photosensitive material include (1) methods in which the picture of a view or a person is taken directly using a camera for example, (2) methods in which an exposure is made though a reversal film or a negative film using a printer or an enlarger, (3) methods in which a scanning exposure of an original is made through a slit using the exposing device of a copying machine for example, (4) methods in which the exposure is made with light emitted from light emitting diodes or various lasers, being controlled by an electrical signal in accordance with picture information, and (5) methods in which exposures are made directly or via an optical system using image information which has been output to image display device such as a CRT, a liquid crystal display, an electroluminescent display or a plasma display for example.

As indicated above, natural light, tungsten lamps, light emitting diodes, laser light sources and CRT light sources for example, the light sources disclosed in column 56 of U.S. Pat. No. 4,500,626, can be used as light sources for recording images on the photosensitive material.

Furthermore, image exposures can also be made using wave-length converting elements in which a non-linear optical material is combined with a coherent light source such as laser light. Here, a non-linear optical material is a material which when irradiated with a strong photoelectric field such as laser light, exhibits a non-linearity between the apparent polarization and the electric field. Inorganic compounds as typified by lithium niobate, potassium dihydrogen phosphate (KDP), lithium iodate and $BaB_2O_4$, and urea derivatives, nitroaniline derivatives, nitropyridine-N-oxide derivatives such as 3-methyl-4-nitropyridine-N-oxide (POM) for example, and the compounds disclosed in JP-A-61-53462 and JP-A-62-210432 are preferably used for this purpose. Any of the known embodiments of wave-length converting elements such as the single crystal optical wave guide type and the fiber type can be used.

Furthermore, the aforementioned image information may be an image signal which has been obtained using a video camera or an electronic still camera for example, a television signal as typified by the Nippon Television Signal Code (NTSC), an image signal obtained by dividing an original into a plurality of picture elements using a scanner for example, or an image signal which has been generated using a computer as typified by CG and CAD for example.

The photosensitive material and/or dye fixing material may have an electrically conductive heat generating layer as a means of heating for thermal development purposes or for the diffusion transfer of dyes by heating. In such a case a transparent or opaque heat generating element as disclosed in JP-A-61-145544 can be used. Moreover, such an electrically conductive layer also functions as an anti-static layer.

Thermal development is possible at temperatures of from about 50° C. to about 250° C., but heating temperatures of from about 80° C. to about 180° C. are especially useful in the thermal development process. A dye diffusion transfer process may be carried out at the same time as thermal development, or it may be carried out after the completion of the thermal development process. In the latter case, transfer is possible with heating temperatures for the transfer process within the range from the temperature for the thermal development process to room temperature, but temperatures of at least 50° C. but about 10° C. lower than the temperature during the thermal development process are preferred.

Dye transfer can be achieved by heat alone, but solvents may be used in order to promote dye transfer Furthermore, the methods in which development and transfer are carried out simultaneously or continuously by heating in the presence of a small amount of solvent (especially water) as described in detail in JP-A-59-218443 and JP-A-61-238056 are also useful. In these methods, the heating temperature is preferably at least 50° C. but no higher than the boiling point of the solvent. For example, when water is used as the solvent, a temperature of at least 50° C. but no higher than 100° C. is desirable.

Water or a basic aqueous solution which contains an inorganic alkali metal salt or an organic base (the bases disclosed in the section on image forming accelerators can be used for the base) are examples of solvents which can be used to accelerate development and/or to transfer a diffusible dye into the dye fixing layer. Furthermore, low boiling point solvents or mixtures of low boiling point solvents and water or basic aqueous solutions, for example, can also be used. Furthermore, surfactants, anti-fogging agents, and sparingly soluble metal salts and complex forming compounds, for example, may be included in the solvent.

These solvents may be applied to the dye fixing material, to the photosensitive material or to both of these materials. The amount used should be small, being less than a weight of solvent corresponding to the maximum swelled volume of the whole coated film (in particular, less than the amount obtained on subtracting the weight of the whole coated film from the weight of solvent corresponding to the maximum swelled volume of the whole coated film).

The method described on page 26 of JP-A-61-147244 can be used, for example, for applying the solvent to the photosensitive layer or dye fixing layer Furthermore, the solvent can also be incorporated into the photosensitive material, the dye fixing material or both of these materials beforehand in a form in which it has been enclosed by micro-encapsulation for example.

Furthermore, methods in which a hydrophilic thermal solvent which is a solid at normal temperature but which melts at elevated temperatures is incorporated in the photosensitive material or dye fixing material can also be adopted for accelerating dye transfer. A hydrophilic thermal solvent may be incorporated into the photosensitive material or the dye fixing material, or it may be incorporated into both of these materials. The layer into which the hydrophilic thermal solvent is incorporated may be an emulsion layer, an interlayer, a protective layer or a dye fixing layer, but it is preferably incorporated into a dye fixing layer and/or a layer adjacent thereto.

Examples of the hydrophilic thermal solvents include ureas, pyridines, amides, sulfonamides, imides, alcohols, oximes and other heterocyclic compounds.

Furthermore, high boiling point organic solvents may be included in the photosensitive material and/or dye fixing material in order to accelerate dye migration.

Sometimes the material is brought into contact with a heated block or plate, sometimes the material is brought into contact with a hot plate, a hot presser, a heated roller, a halogen lamp heater or an infrared or far-infrared lamp heater for example, and sometimes the material is passed through a high temperature atmosphere as a means of heating it in the development and/or transfer process.

A method by which a photosensitive material and a dye fixing material are brought together under the pressing conditions during contact and with pressure applied as disclosed on page 27 of JP-A-61-147244 can be used.

Any of the known thermal development devices can be used for processing photographic elements of the present invention. For example, the devices disclosed, for example, in JP-A-59-75247, JP-A-59-177547, JP-A-59-181353, JP-A-60-18951 and JP-A-U-62-25944 may be used. (The term "JP-A-U" as used herein signifies an "unexamined published Japanese utility model application".)

Illustrative examples are described below, but the invention is not limited to these examples.

EXAMPLE 1

Preparation of Silver Halide Emulsions (1) Emulsion (I) (For the Blue Sensitive Layer)

Solutions (I) and (II) indicated below were added simultaneously over a period of 30 minutes to a thoroughly agitated aqueous gelatin solution (a solution obtained by adding 20 grams of gelatin, 0.5 gram of potassium bromide, 6 grams of sodium chloride and 30 mg of Reagent A indicated below to 800 ml of water and maintaining at a temperature of 65° C.). Subsequently, Solutions (III) and (IV) indicated below were added simultaneously over a period of 30 minutes. Furthermore, a solution of the sensitizing dye indicated below was added 5 minutes after completing the addition of Solutions (III) and (IV).

After washing with water and desalting, 20 grams of lime treated ossein gelatin was added. After adjustment to pH 6.2 and pAg 7.9, Reagent B indicated below, 4-hydroxy-6-methyl-1,3,3a,7-tetra-azaindene, and chloroauric acid were added and the mixture was chemically sensitized optimally at 60° C. A monodisperse cubic silver chlorobromide emulsion (600 grams) of average grain size 0.50μ was obtained in this way.

| | Solution (I) | Solution (II) | Solution (III) | Solution (IV) |
|---|---|---|---|---|
| $AgNO_3$ | 50.0 grams | — | 50.0 grams | — |
| KBr | — | 24.0 grams | — | 28.0 grams |
| NaCl | — | 5.2 grams | — | 3.5 grams |
| Water to | 180 ml | 180 ml | 350 ml | 350 ml |

Dye Solution: The sensitizing dye indicated below (240 mg) and 760 mg of the surfactant indicated below were dissolved in 58 ml of water.

Sensitizing Dye:

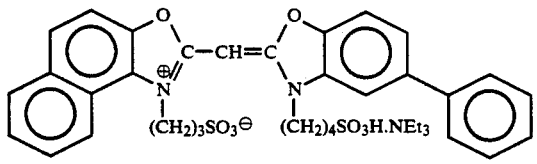

Surfactant:

$C_{12}H_{25}POSO_3Na$

Reagent A:

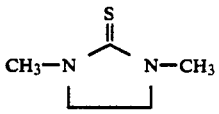

Reagent B:

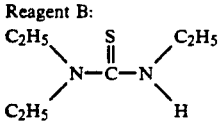

(2) Emulsion (II) (For the Blue Sensitive Layer) Solutions (I) and (II) indicated below were added simultaneously over a period of 30 minutes to a thoroughly agitated aqueous gelatin solution (a solution obtained by adding 20 grams of gelatin, 0.5 gram of potassium bromide, 6 grams of sodium chloride and 30 mg of Reagent A to 800 ml of water and maintaining at a temperature of 50° C.). Subsequently, Solutions (III) and (IV) indicated below were added simultaneously over a period of 30 minutes. Furthermore, a solution of sensitizing dye as described above was added 5 minutes after completing the addition of Solutions (III) and (IV).

After washing with water and desalting, 20 grams of lime treated ossein gelatin was added. After adjustment to pH 6.2 and pAg 7.9, Reagent B, 4-hydroxy-6-methyl-1,3,3a,7-tetraazaindene, and chloroauric acid were added and the mixture was chemically sensitized optimally at 60° C. A mono-disperse cubic silver chlorobromide emulsion (600 grams) of average grain size 0.38μ was obtained in this way.

| | Solution (I) | Solution (II) | Solution (III) | Solution (IV) |
|---|---|---|---|---|
| $AgNO_3$ | 50.0 grams | — | 50.0 grams | — |
| KBr | — | 24.0 grams | — | 28.0 grams |
| NaCl | — | 5.2 grams | — | 3.5 grams |
| Water to | 180 ml | 180 ml | 350 ml | 350 ml |

(3) Emulsion (III) (For the Green Sensitive Layer)

Solutions (I) and (II) indicated below were added simultaneously over a period of 30 minutes to a thoroughly agitated aqueous gelatin solution (a solution obtained by adding 20 grams of gelatin, 0.30 gram of potassium bromide, 6 grams of sodium chloride and 15 mg of Reagent A to 730 ml of water and maintaining at a temperature of 50° C.). Subsequently, Solutions (III) and (IV) were added simultaneously over a period of 30 minutes, and the dye solution indicated below was added 1 minute after completing the addition.

After washing with water and desalting, 20 grams of gelatin was added and optimal chemical sensitization was carried out using 4-hydroxy-6-methyl-1,3,3a,7-tetraazaindene, chloroauric acid and triethylthiourea of which the pH had been adjusted.

The emulsion obtained was a mono-disperse cubic emulsion of average grain size 0.4μ, and ultimately 630 grams was obtained.

| | Solution (I) | Solution (II) | Solution (III) | Solution (IV) |
|---|---|---|---|---|
| $AgNO_3$ | 50.0 grams | — | 50.0 grams | — |
| KBr | — | 21.0 grams | — | 28.0 grams |
| NaCl | — | 6.9 grams | — | 3.5 grams |
| Water to | 200 ml | 200 ml | 200 ml | 200 ml |

Dye Solution: The dye indicated below (230 mg) was dissolved in 154 ml of methanol.

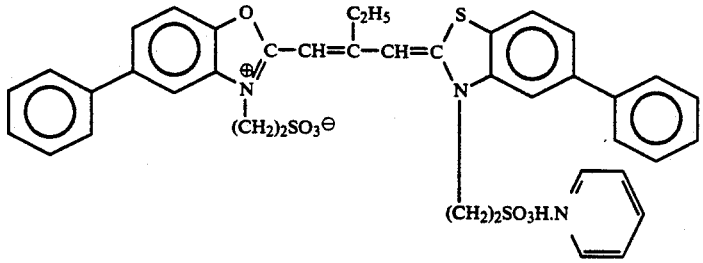

(4) Emulsion (IV) (For the Red Sensitive Emulsion Layer)

Solutions (I) and (II) indicated below were added simultaneously at an equal flow rate over a period of 30 minutes to a thoroughly agitated aqueous gelatin solution (a solution obtained by adding 20 grams of gelatin, 0.3 gram of potassium bromide, 6 grams of sodium chloride and 30 mg of Reagent A to 800 ml of water and maintaining at a temperature of 50° C.). Subsequently, Solutions (III) and (IV) indicated below were added simultaneously over a period of 30 minutes. Furthermore, the dye solution indicated below was added over a period of 20 minutes starting 3 minutes after the commencement of the addition of solutions (III) and (IV).

After washing with water and desalting, 22 grams of lime treated ossein gelatin was added and, after adjusting to pH 6.2 and pAg 7.7, sodium thiosulfate, 4-hydroxy-6-methyl-1,3,3a,7-tetraazaindene, and chloroauric acid were added and chemical sensitization was carried out optimally at 60° C. A mono-disperse cubic silver chlorobromide emulsion of average grain size 0.38μ was obtained. The yield was 635 grams.

| | Solution (I) | Solution (II) | Solution (III) | Solution (IV) |
|---|---|---|---|---|
| $AgNO_3$ | 50.0 grams | — | 50.0 grams | — |
| KBr | — | 28.0 grams | — | 35.0 grams |
| NaCl | — | 3.4 grams | — | — |
| Water to | 200 ml | 200 ml | 200 ml | 200 ml |

Dye Solution: Dye (a) indicated below (67 mg) and 133 mg of Dye (b) were dissolved in 100 ml of methanol.

Sensitizing Dye (a):

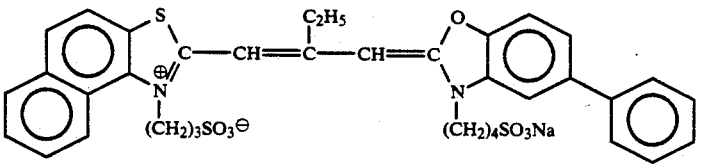

Sensitizing Dye (b):

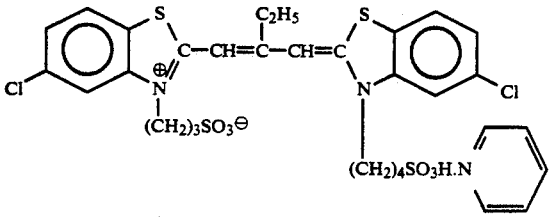

Preparation of Gelatin Dispersions (5) Preparation of Dye Providing Compound Gelatin Dispersion The yellow, magenta and cyan formulations indicated below were weighed out and heated to about 60° C. and dissolved to provide uniform solutions. Each solution was mixed with agitation with 100 grams of a 10% aqueous lime treated gelatin solution, 0.6 gram of sodium dodecylbenzenesulfonate and 50 ml of water and then dispersed at 10,000 rpm for 10 minutes in a homogenizer. The dispersions obtained are referred to as the gelatin dispersions of the yellow, magenta and cyan dye providing compounds, respectively.

| | Yellow (1) | Magenta (2) | Cyan (3) |
|---|---|---|---|
| Dye providing compound | 13 grams | 15.5 grams | 16.6 grams |
| Electron donor (1) indicated below | 10.2 grams | 8.6 grams | 8.1 grams |
| High boiling point solvent (2) indicated below | 6.5 grams | 7.8 grams | 8.3 grams |
| Electron transfer agent precursor (3) indicated below | 0.4 gram | 0.7 gram | 0.7 gram |
| $CO_2C_{12}H_{25}$ \| $CO_2C_{12}H_{25}$ | 3.9 grams | — | — |
| Ethyl acetate | 50 ml | 50 ml | 50 ml |

(6) Preparation of the Interlayer Electron Donor Gelatin Dispersion

Electron Donor (4) indicated below (23.6 grams) and 8.5 grams of High Boiling Point Solvent (2) indicated below were added to 30 ml of ethyl acetate and heated to 60° C. to obtain a uniform solution. This solution was mixed with agitation with 100 grams of a 10% aqueous solution of lime treated gelatin, 0.25 gram of sodium bisulfite, 0.3 gram of sodium dodecylbenzenesulfonate and 30 ml of water and then dispersed for 10 minutes at 10,000 rpm in a homogenizer. This dispersion is referred to as the gelatin dispersion of Electron Donor (4).

Dye Providing Compounds:

(1) Yellow Dye Providing Compound

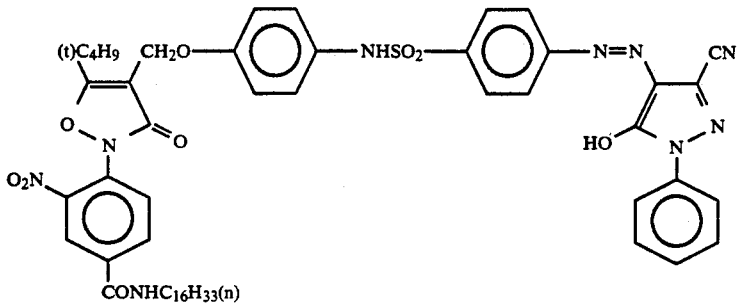
(2) Magenta Dye Providing Compound
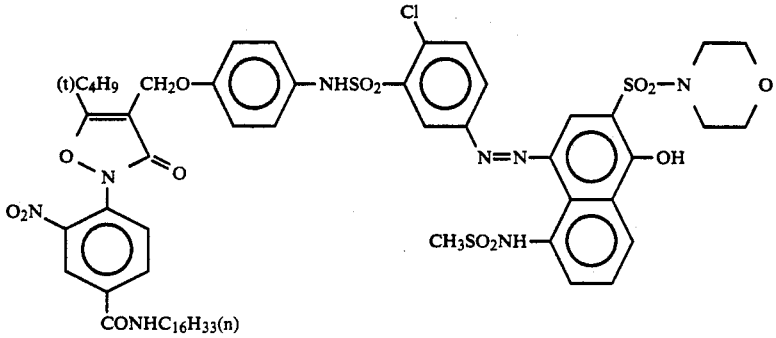
(3) Cyan Dye Providing Compound
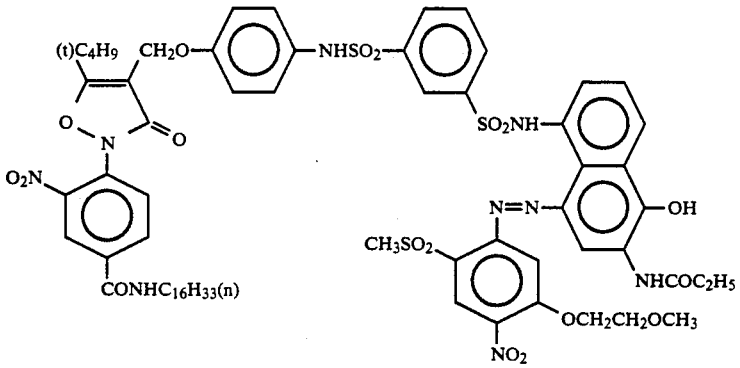
Electron Donor (1):
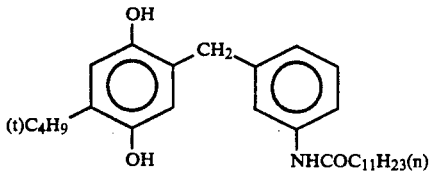
High Boiling Point Solvent (2):
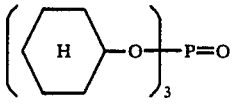
Electron Transfer Agent Precursor (3):
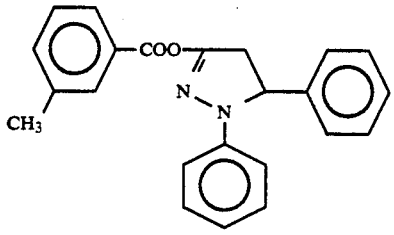
Electron Donor (4):

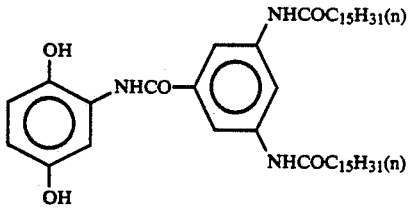

(7) Preparation of Zinc Hydroxide Dispersion

Zinc hydroxide of average particle size 0.2μ (12.5 grams), 0.1 gram of poly(sodium acrylate) and 1 gram of carboxymethyl cellulose as a dispersant were added to 100 ml of a 4% aqueous gelatin solution. The mixture was pulverized for 30 minutes using glass beads of average diameter 75 mm in a mill, after which the glass beads were removed and a dispersion of zinc hydroxide was obtained.

(8) Preparation of Active Carbon Dispersion

Active carbon powder (special reagent grade, 2.5 grams) made by Wako Pure Chemical Industries, Ltd. and 0.25 gram of polyethylene glycol nonylphenyl ether and 1 gram of Demol N ® made by Kao Corporation as a dispersant were added to 100 ml of a 5% aqueous gelatin solution and pulverized for 120 minutes using glass beads of average diameter 0.75 mm in a mill. The glass beads were then removed and a dispersion of active carbon of average particle size 0.5 μm was obtained.

(9) Preparation of Gelatin Dispersion of Electron Transfer Agent

Electron Transfer Agent (10) indicated below (10 grams), 0.5 gram of the anionic surfactant indicated below and 0.5 gram of polyethylene glycol nonylphenyl ether as a dispersant were added to 100 ml of a 5% aqueous gelatin solution and pulverized for 60 minutes using glass beads of average diameter 0.75 mm in a mill. The glass beads were then removed and a dispersion of electron transfer agent of average particle size 0.4 μm was obtained.

Electron Transfer Agent (10):

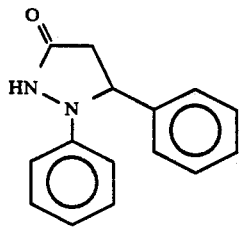

Anionic Surfactant:

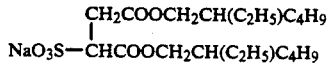

Photosensitive Material 101, the structure of which is shown in the following table, was obtained using these materials.

Photosensitive Material (1)

| Layer Number | Layer Name | Formulation | Coated Weight (mg/m²) |
|---|---|---|---|
| Sixth Layer | Protective layer | Gelatin | 777 |
| | | Silica (size 4μ) | 40 |
| | | Zinc hydroxide | 772 |
| | | Surfactant (5) (Note 1) | 130 |
| | | Surfactant (6) (Note 2) | 26 |
| | | Water soluble polymer (Note 3) | 8 |
| Fifth Layer | Blue Sensitive Emulsion Layer | Blue sensitive silver halide emulsion (I) | 89 as silver |
| | | Blue sensitive silve halide emulsion (II) | 355 as silver |
| | | Yellow dye providing compound (1) | 411 |
| | | Gelatin | 539 |
| | | Electron donor (1) | 325 |
| | | High boiling point solvent (2) | 206 |
| | | Surfactant (7) (Note 5) | 18 |
| | | Water soluble polymer (Note 3) | 13 |
| Fourth Layer | Interlayer | Gelatin | 555 |
| | | Electron donor (4) | 187 |
| | | High boiling point solvent (2) | 48 |
| | | Surfactant (6) (Note 2) | 15 |
| | | Surfactant (8) (Note 6) | 4 |
| | | Surfactant (7) (Note 5) | 30 |
| | | Electron transfer agent (10) | 82 |
| | | Water soluble polymer (Note 3) | 19 |
| | | Film hardening agent (11) (Note 7) | 37 |
| Third Layer | Green Sensitive Emulsion Layer | Green sensitive silver halide emulsion (III) | 256 as silver |
| | | Magenta dye providing compound (2) | 359 |
| | | Gelatin | 359 |
| | | Electron donor (1) | 198 |
| | | High boiling point solvent (2) | 183 |
| | | Electron transfer agent precursor (3) | 33 |
| | | Surfactant (7) (Note 5) | 13 |
| | | Water soluble polymer (Note 3) | 11 |
| Second Layer | Interlayer | Gelatin | 660 |
| | | Zinc hydroxide | 504 |
| | | Electron donor (4) | 190 |
| | | High boiling point solvent (2) | 73 |
| | | Surfactant (7) (Note 5) | 2 |
| | | Surfactant (8) (Note 6) | 100 |
| | | Surfactant (6) (Note 2) | 50 |
| | | Water soluble polymer (Note 3) | 12 |
| | | Active carbon | 25 |

-continued

| | | | | |
|---|---|---|---|---|
| First Layer | Red Sensitive Emulsion Layer | Red sensitive silver halide emulsion (IV) | 260 | as silver |
| | | Cyan dye providing compound (3) | 352 | |
| | | Gelatin | 342 | |
| | | Electron donor (1) | 180 | |
| | | High boiling point solvent (2) | 172 | |
| | | Electron transfer agent precursor (3) | 30 | |
| | | Surfactant (7) (Note 5) | 10 | |
| | | Water soluble polymer (Note 3) | 5 | |
| Support | Poly(ethylene terephthalate): | 96μ (Carbon black layer on reverse side) | | |

(Note 1) Surfactant (5)

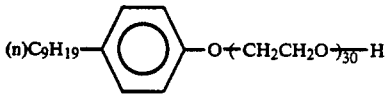

(Note 2) Surfactant (6)

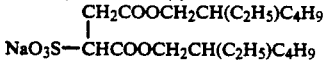

(Note 3) Water Soluble Polymer

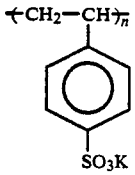

(Note 5) Surfactant (7)

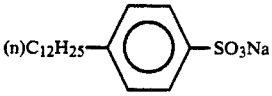

(Note 6) Surfactant (8)

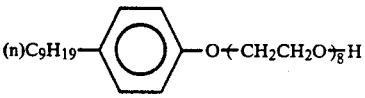

(Note 7) Film Hardending Agent (11)
1,2-Bis(vinylsulfonylacetamido)ethane

Photosensitive Materials 102 and 103 (for comparison) were prepared in the same way except that conventional anti-foggants as shown in Table 1 below were added to the first, third and fifth layers respectively of Photosensitive Material 101 described above.

Furthermore, Photosensitive Materials 104 to 110 were prepared in the same way except that compounds of the present invention were used as shown in Table 1 instead of the conventional anti-foggants.

Moreover, the conventional Anti-foggants A, B and C indicated below were used in Photosensitive Materials 2 and 3.

Anti-foggant A:

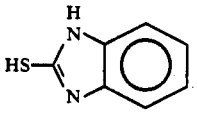

Anti-foggant B:

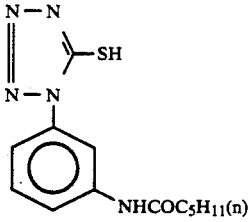

Anti-foggant C:

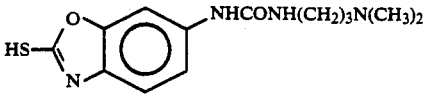

Structure of Image Receiving Material (1)

| Number | Additive | Amount Added ($g/m^2$) |
|---|---|---|
| Third Layer | Water soluble polymer (1) | 0.05 |
| | Silicone oil (1) | 0.04 |
| | Surfactant (1) | 0.001 |

-continued

Structure of Image Receiving Material (1)

| Number | Additive | Amount Added ($g/m^2$) |
|---|---|---|
| | Surfactant (2) | 0.02 |
| | Surfactant (3) | 0.10 |
| | Matting agent (1) | 0.02 |
| | Guanidine picolinate | 0.45 |
| | κ carrageenan | 0.24 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (5) | 0.15 |
| First Layer | Gelatin | 0.45 |
| | Surfactant (3) | 0.01 |
| | Water soluble polymer (1) | 0.04 |
| | Film hardening agent (1) | 0.30 |
| Support (1) | | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5) | 0.01 |
| | Matting agent (2) | 0.03 |

Structure of Support (1)

| Layer Name | Composition | | Film Thickness (μ) |
|---|---|---|---|
| Surface Subbing Layer | Gelatin | | 0.1 |
| Surface PE Layer (Glossy) | Low density polyethylene (density 0.923) | 89.2 parts | 45.0 |
| | Surface treated titanium oxide | 10.0 parts | |
| | Ultramarine | 0.8 part | |
| Pulp Layer | Wood-free paper (LBKP/NBKP = 1:1, density 1.080) | | 92.6 |
| Reverse Side PE Layer (Matt) | High density polyethylene (density 0.960) | | 36.0 |
| Reverse Side | Gelatin | | 0.05 |
| | Colloidal silica | | 0.05 |
| TOTAL | | | 173.8 |

Silicone Oil (1):

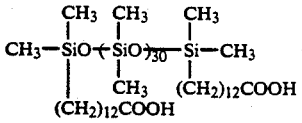

Surfactant (1):

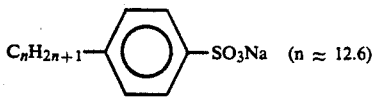

Surfactant (2):

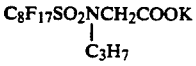

Surfactant (3):

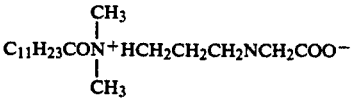

Surfactant (4):

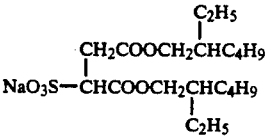

Fluorescent Whitener (1): 2,5-Bis(5-tert-butylbenzoxazolyl(2))thiophene

Surfactant (5):

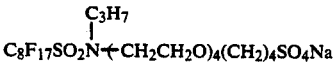

Water Soluble Polymer (1): Sumikagel® L-5-H (made by Sumitomo Chemical Co., Ltd.)

Water Soluble Polymer (2): Dextran (Molecular weight 70,000)

Mordant (1):

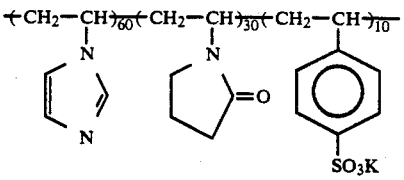

High Boiling Point Solvent (1):

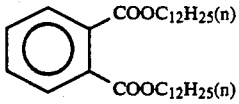

Film Hardening Agent (1):

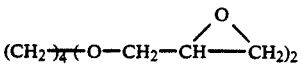

Matting Agent (1)*: Silica

Mating Agent (2)*: Benzoguanamine resin (average particle size 15μ)

Processing was carried out as indicated below using the above mentioned sensitive materials and image receiving material.

Thus, each of the photosensitive materials was exposed using a tungsten lamp at 4000 lux for 1/10 second through B, G, R and gray wedges the density of which changed continuously.

The exposed photosensitive material was then fed at a line speed of 20 mm/sec, water was supplied at a rate of 15 ml/m$^3$ to the emulsion surface using a wire bar and then this material was laminated immediately with the film surface in contact with the image receiving material. The laminate was then heated for 15 seconds using a heated roller the temperature of which was controlled in such a way that the temperature of the film which had taken up the water was set at 85° C. and, on peeling away the image receiving material subsequently, clear B, G, R and gray images were obtained.

Next, the maximum density ($D_{max}$) and minimum density ($D_{min}$) of each of the cyan, magenta and yellow colors of the gray part were measured and the results obtained are shown in Table 1.

TABLE 1

| Photosensitive Material | Compound Added to the First Layer | | Compound Added to the Third Layer | | Compound added to the Fifth Layer | |
|---|---|---|---|---|---|---|
| | Compound No. | Amount Added* | Compound No. | Amount Added* | Compound No. | Amount Added* |
| 1 (Comparative Example) | — | — | — | — | — | — |
| 2 (Comparative Example) | A | $1.0 \times 10^{-3}$ | A | $1.0 \times 10^{-3}$ | B | $0.8 \times 10^{-3}$ |
| 3 (Comparative Example) | C | $1.4 \times 10^{-3}$ | C | $1.3 \times 10^{-3}$ | B | $1.2 \times 10^{-3}$ |
| 4 (This Invention) | 2 | $1.2 \times 10^{-3}$ | 2 | $1.2 \times 10^{-3}$ | 2 | $1.0 \times 10^{-3}$ |
| 5 (This Invention) | 4 | $1.1 \times 10^{-3}$ | 4 | $1.1 \times 10^{-3}$ | 2 | $1.0 \times 10^{-3}$ |
| 6 (This Invention) | 6 | $1.0 \times 10^{-3}$ | 6 | $1.0 \times 10^{-3}$ | 10 | $0.9 \times 10^{-3}$ |
| 7 (This Invention) | 8 | $1.3 \times 10^{-3}$ | 8 | $1.3 \times 10^{-3}$ | 10 | $0.9 \times 10^{-3}$ |
| 8 (This Invention) | 2 | $1.2 \times 10^{-3}$ | 2 | $1.2 \times 10^{-3}$ | 13 | $1.1 \times 10^{-3}$ |
| 9 (This Invention) | 24 | $1.5 \times 10^{-3}$ | 24 | $1.6 \times 10^{-3}$ | 15 | $1.1 \times 10^{-3}$ |
| 10 (This Invention) | 2 | $1.2 \times 10^{-3}$ | 4 | $1.1 \times 10^{-3}$ | 21 | $1.2 \times 10^{-3}$ |

| Photosensitive Material No. | Cyan | | Magenta | | Yellow | |
|---|---|---|---|---|---|---|
| | Dmax | Dmin | Dmax | Dmin | Dmax | Dmin |
| 1 (Comparative Example) | 1.14 | 0.08 | 1.25 | 0.14 | 1.06 | 0.10 |
| 2 (Comparative Example) | 1.82 | 0.32 | 1.94 | 0.26 | 1.66 | 0.14 |
| 3 (Comparative Example) | 1.98 | 0.27 | 2.02 | 0.24 | 2.18 | 0.23 |
| 4 (This Invention) | 2.18 | 0.10 | 2.31 | 0.15 | 2.20 | 0.12 |
| 5 (This Invention) | 2.24 | 0.13 | 2.40 | 0.16 | 2.24 | 0.13 |
| 6 (This Invention) | 2.15 | 0.12 | 2.30 | 0.16 | 2.17 | 0.13 |
| 7 (This Invention) | 2.16 | 0.13 | 2.27 | 0.16 | 2.20 | 0.13 |
| 8 (This Invention) | 2.20 | 0.11 | 2.28 | 0.15 | 2.12 | 0.14 |
| 9 (This Invention) | 2.12 | 0.13 | 2.32 | 0.17 | 2.08 | 0.12 |
| 10 (This Invention) | 2.22 | 0.11 | 2.35 | 0.16 | 2.13 | 0.12 |

*The amount added in mol per mol of silver halide

It is clear from the results shown in Table 1 below that the photosensitive materials in which compounds of the present invention had been used had good image discrimination characteristics with a high maximum density and a low minimum density.

EXAMPLE 2

The preparation of Silver Halide Emulsion (I) for the fifth layer is described below.

An aqueous solution of silver nitrate (obtained by dissolving 50 grams of $AgNO_3$ in water and making up to a total volume of 300 ml) and an aqueous halogen solution (obtained by dissolving 22.8 grams of KBr and 6 grams of NaCl in water and making up to a total volume of 300 ml) were added simultaneously over a period of 30 minutes to a thoroughly agitated aqueous gelatin solution (obtained by dissolving 20 grams of lime treated deionized ossein gelatin (Ca content 20 ppm), 4 grams of sodium chloride, 0.1 gram of potassium bromide and 0.015 gram of the compound indicated below in 800 ml of water and maintaining at a temperature of 65° C.).

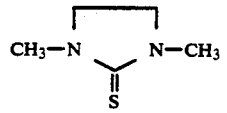

Next, the temperature of the solution was reduced to 35° C. and an aqueous solution of silver nitrate (obtained by dissolving 50 grams of $AgNO_3$ in water and making up to a total volume of 300 ml) and an aqueous halide solution (obtained by dissolving 31.5 grams of KBr and 1.7 grams of NaCl in water and making up to a total volume of 300 ml) were added simultaneously over a period of 30 minutes.

After washing with water and desalting, 25 grams of lime treated ossein gelatin (guanine content 50 ppm) and 100 ml of water were added and the pH and pAg values were adjusted to 6.3 and 7.9, respectively.

The emulsion so obtained was maintained at 55° C. and chemical sensitization was carried out optimally using 0.8 mg of triethylthiourea and 100 mg of 4-hydroxy-6-methyl-1,3,3a,7-tetraazaindene. The yield of the emulsion was 650 grams.

The preparation of Silver Halide Emulsion (II) for the third layer is described below.

An aqueous solution of $AgNO_3$ (obtained by dissolving 100 grams of $AgNO_3$ in water and making up to a total volume of 600 ml) and an aqueous halide solution (obtained by dissolving 54.5 grams of KBr and 2 grams of NaCl in water and making up to a total volume of 600 ml) were added simultaneously to a well agitated aqueous lime treated ossein gelatin (0.4% ash, adenine content 0.2 ppm) solution (obtained by dissolving 50 grams of gelatin, 10 grams of sodium chloride, 0.1 gram of potassium iodide and 5 cc of sodium hydroxide (1N) in 00 ml of water and maintaining at a temperature of 60° C.) taking 30 minutes for the whole addition. One minute after completing this addition, a dye solution obtained by dissolving 0.2 gram of Sensitizing Dye (A) and 0.2 gram of Sensitizing Dye (B) in 120 ml of water and 120 ml of methanol was added, and then 10 ml of a 1% aqueous solution of potassium iodide was added after a further period of 5 minutes.

Sensitizing Dye (A):

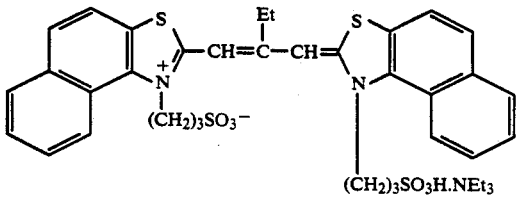

Sensitizing Dye (B):

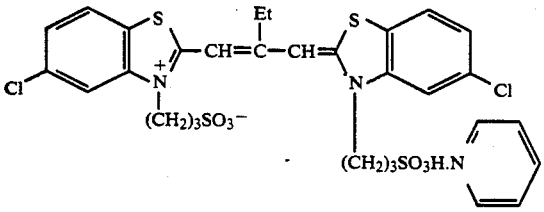

After washing with water and desalting, 10 grams of lime treated ossein gelatin (adenine content 20 ppm) and 50 ml of water were added, and the pH and pAg values were adjusted to 6.0 and 7.6, respectively.

The emulsion obtained was maintained at 60° C. and chemical ripening was carried out for 50 minutes using 2.5 mg of hypo. The yield of the emulsion was 500 grams.

The preparation of Silver Halide Emulsion (III) for the first layer is described below.

Solutions I and II indicated below were added simultaneously at first, the addition of Solution I taking 12 minutes and the addition of Solution II taking 8 minutes, to a well agitated aqueous lime treated ossein gelatin (Ca content 2500 ppm) solution (obtained by dissolving 20 grams of gelatin, 2 grams of sodium chloride and 0.015 gram of the compound indicated below in 800 ml of water and maintaining at 50° C.).

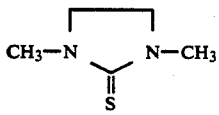

Solution IV was added over a period of 44 minutes, starting 16 minutes after completing the addition of Solution I, and Solution III was added over a period of 40 minutes, starting 20 minutes after completing the addition of Solution I. Furthermore, the pAg value was 6.7 from the completion of the addition of Solution I until the start of the addition of Solution III.

| | Solution I Total | Solution II Total | | Solution III Total | Solution IV Total | |
|---|---|---|---|---|---|---|
| Emulsion III | 100 ml | 60 ml | | 500 ml | 540 ml | |
| | $AgNO_3$ (g) | KBr (g) | NaCl (g) | $AgNO_3$ (g) | KBr (g) | NaCl (g) |
| | 15 | 4.9 | 1 | 85 | 44.1 | 9 |

After washing with water and desalting, 25 grams of lime treated ossein gelatin (Ca content 4000 ppm) and 100 ml of water were added, the pH was adjusted to 6.0 and the pAg was adjusted to 7.7. Subsequently, chemical sensitization was carried out optimally at 55° C. using 1.1 mg of triethylthiourea and 60 mg of 4-hydroxy-6-methyl- 1,3,3a,7-tetraazaindene. The yield of the emulsion was 650 grams.

The preparation of organo-silver salts is described below.

Organo-silver Salt (1)

The preparation of a benzotriazole silver emulsion is described below.

Gelatin (28 grams) and 13.2 grams of benzotriazole were dissolved in 300 ml of water. The solution so obtained was agitated while being maintained at 40° C. A solution obtained by dissolving 17 grams of silver nitrate in 100 ml of water was added to this solution over a period of 2 minutes.

The pH of this benzotriazole silver emulsion was adjusted, the emulsion was precipitated and the excess salt was removed. Subsequently, the pH was set to 6.30 and 400 grams of benzotriazole silver emulsion was Organo-silver Salt (2)

Gelatin (20 grams) and 5.9 grams of 4-acetylaminophenylpropiolic acid were dissolved in 1000 ml of 1% aqueous sodium hydroxide solution and 200 ml of ethanol.

This solution was maintained at 40° C. and agitated.

A solution obtained by dissolving 4.5 grams of silver nitrate in 200 ml of water was added to the solution over a period of 5 minutes.

The pH of the dispersion was adjusted, the dispersion was sedimented and the excess salt was removed. Subsequently, the pH was set to 6.3 and 300 grams of a dispersion of organo-silver salt (2) was recovered.

The preparation of gelatin dispersions of the dye providing substances is described below.

The yellow Dye Providing Substance (A) (15 grams), 1.2 grams of reducing agent, 0.3 gram of mercapto compound (1), 1.5 grams of surfactant (4) and 7.5 grams of high boiling point organic solvent (1) were weighed out, 45 ml of ethyl acetate was added. The mixture was heated to about 60° C., and a uniform solution was obtained. This solution, 100 grams of a 10% lime treated gelatin solution and 30 ml of water were mixed with agitation and then dispersed at 10,000 rpm for 10 minutes in a homogenizer. This dispersion is referred to as the yellow dye providing substance dispersion.

The magenta Dye Providing Substance (B) (15 grams), 0.6 grams of reducing agent, 0.15 gram of mercapto compound (1), 1.5 grams of surfactant (4) and 5.3 grams of high boiling point organic solvent (2) were weighed out, 25 ml of ethyl acetate was added, the mixture was heated to 60° C. and a uniform solution was obtained. This solution, 100 grams of a 10% lime treated gelatin solution and 30 ml of water were mixed with agitation and then dispersed at 10,000 rpm for 10 minutes in a homogenizer. This dispersion is referred to as the magenta dye providing substance dispersion.

The cyan Dye Providing Substance (C) (15 grams), 0.8 grams of reducing agent, 0.6 gram of mercapto compound (1), 1.5 grams of surfactant (4) and 8.3 grams of high boiling point organic solvent (1) were weighed out, 30 ml of ethyl acetate was added, the mixture was heated to 60° C. and a uniform solution was obtained. This solution, 100 grams of a 10% lime treated gelatin solution and 30 ml of water were mixed with agitation and then dispersed at 10,000 rpm for 10 minutes in a homogenizer. This dispersion is referred to as the cyan dye providing substance dispersion.

Heat developable Photosensitive Material 200 the structure of which is indicated below was prepared using these materials.

| Heat Developable Photosensitive Material 200 | | | |
|---|---|---|---|
| Layer Number | Layer Name | Additive | Amount Added (g/m$^2$) |
| Sixth Layer | Protective Layer | Gelatin | 0.72 |
| | | Matting agent, Silica (size 4μ) | 0.023 |
| | | Water soluble polyer (1) | 0.18 |
| | | Surfactant (1) | 0.051 |
| | | Surfactant (2) | 0.090 |
| | | Surfactant (3) | 0.029 |
| | | Film hardening agent | 0.049 |
| Fifth Layer | Green Sensitive Layer | Emulsion (I) | as silver 0.27 |
| | | Benzotriazole | $2.2 \times 10^{-3}$ |
| | | Sensitizing dye (1) | $9.5 \times 10^{-4}$ |
| | | Yellow dye providing compound (A) | 0.29 |
| | | High boiling point organic solvent (1) | 0.15 |
| | | Reducing Agent | 0.023 |
| | | Mercapto compound (1) | $2.9 \times 10^{-3}$ |
| | | Surfactant (4) | 0.032 |
| | | Gelatin | 0.42 |
| | | Water soluble polymer (2) | |
| Fourth Layer | Interlayer | Gelatin | 0.56 |
| | | $Zn(OH)_2$ | 0.24 |
| | | Benzotriazole | $1.7 \times 10^{-3}$ |
| | | Surfactant (1) | $8.8 \times 10^{-3}$ |
| | | Surfactant (5) | $4.6 \times 10^{-3}$ |
| | | Water soluble polymer (2) | 0.010 |
| Third Layer | Red Sensitive Layer | Emulsion (II) | as silver 0.1 |
| | | Organo-silver salt (1) | as silver $1.9 \times 10^{-3}$ |
| | | Organo-silver salt (2) | as silver 0.016 |
| | | Magenta dye providing substance (B) | 0.24 |
| | | High boiling point organic solvent (2) | 0.8 |
| | | Reducing agent | $9.5 \times 10^{-3}$ |
| | | Mercapto compound (1) | $1.2 \times 10^{-3}$ |
| | | Surfactant (5) | 0.023 |
| | | Gelatin | 0.31 |
| | | Water soluble polymer (2) | $7.4 \times 10^{-3}$ |
| | | Surfactant (5) | 0.026 |
| Second Layer | Interlayer | Gelatin | 0.62 |
| | | $Zn(OH)_2$ | 0.19 |
| | | Surfactant (1) | $5.9 \times 10^{-3}$ |
| | | Surfactant (5) | $3.2 \times 10^{-3}$ |
| | | Surfactant (6) | 0.056 |
| | | Water soluble polymer (2) | $4.5 \times 10^{-3}$ |
| First Layer | Infrared Sensitive Layer | Emulsion (III) | as silver 0.20 |
| | | Organo-silver salt (1) | as silver 0.032 |
| | | Organo-silver salt (2) | as silver 0.016 |
| | | Mercapto compound (2) | $3.2 \times 10^{-4}$ |
| | | Sensitizing dye (2) | $2.5 \times 10^{-5}$ |
| | | Cyan dye providing substance (C) | 0.26 |
| | | High boiling point organic solvent (1) | 0.14 |
| | | Reducing agent | 0.014 |
| | | Mercapto compound (1) | 0.011 |
| | | Surfactant (4) | 0.029 |
| | | Surfactant (5) | $8.1 \times 10^{-3}$ |
| | | Gelatin | 0.28 |
| | | Water soluble polymer (2) | 0.014 |
| Support (Poly(ethylene terephthalate), Thickness 100μ) | | | |
| Backing Layer | | Carbon black | 0.44 |
| | | Poly(vinyl chloride) | 0.30 |

Yellow Dye Providing Substance (A):

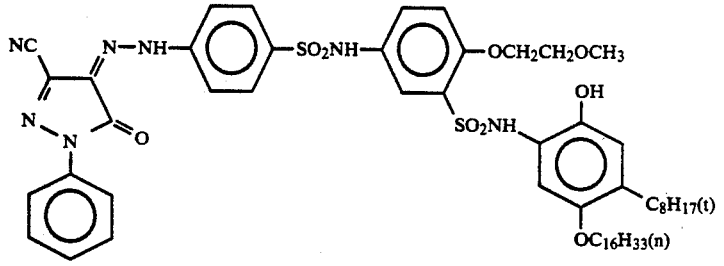
Magenta Dye Providing Substance (B):
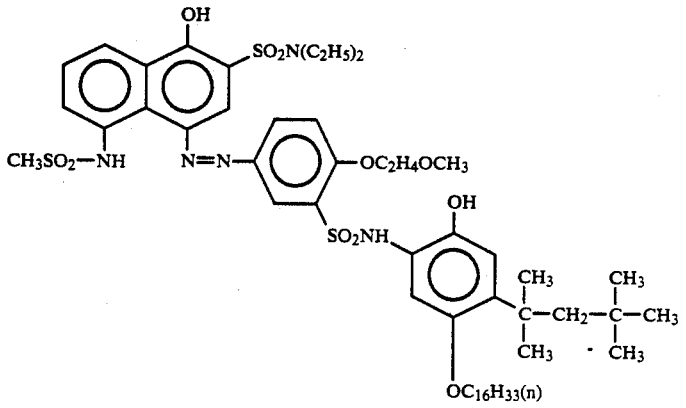
Cyan Dye Providing Substance (C):
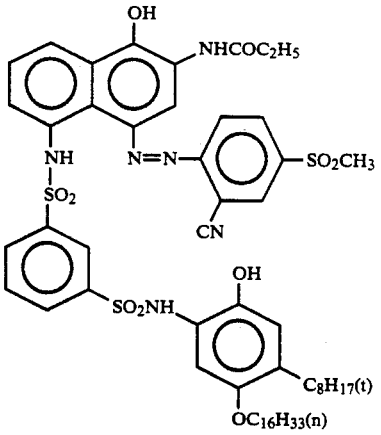
Water Soluble Polymer (1): Sumikagel® L-5(H) Made by the Sumitomo Chemical Co., Ltd.
Water Soluble Polymer (2):
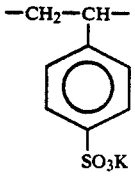
Surfactant (1): Aerosol® OR
Surfactant (2):
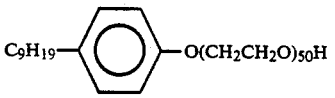
Surfactant (3):
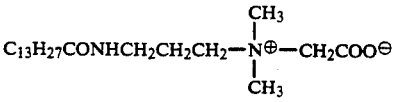
Surfactant (4):
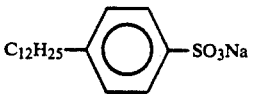
Surfactant (5):
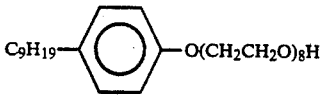
Surfactant (6):
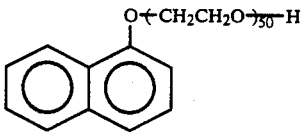

Film Hardening Agent:

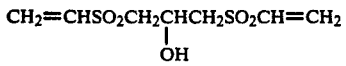

Sensitizing Dye (1):

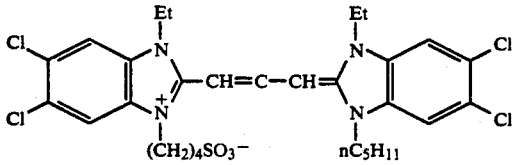

Sensitizing Dye (2):

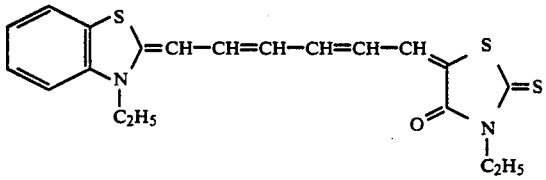

Reducing Agent:

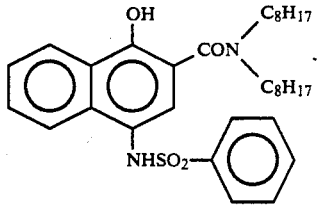

Mercapto Compound (1):

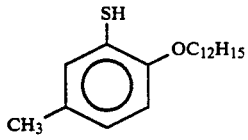

Mercapto Compound (2):

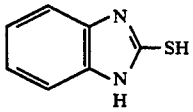

High Boiling Point Organic Solvent (1): Triisononyl phosphate

High Boiling Point Organic Solvent (2): Trihexyl phosphate

Comparative Photosensitive Material 201 was prepared by adding Compound A indicated below in Table 2 to the third and fifth layers in Photosensitive Material 200 mentioned above. Furthermore, Comparative Photosensitive Material 202 was prepared similarly by adding Compounds B and C as indicated in Table 2.

Compound A:

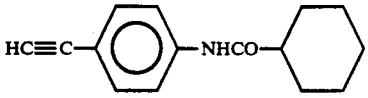

Compound B:

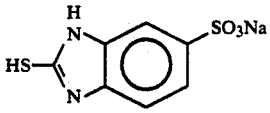

Compound C:

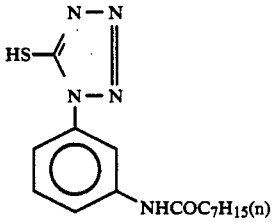

Moreover, Photosensitive Materials 203 to 208 of this invention were prepared by adding compounds of the present invention to the third and fifth layers respectively as shown in Table 2.

The preparation of the dye fixing material is described below.

The Dye Fixing Material R-1 was prepared by coating the structure indicated below on a paper support which had been laminated with polyethylene.

Structure of Dye Fixing Material R-1

| Layer No. | Additive | Amount Added ($g/m_2$) |
|---|---|---|
| Third Layer | Gelatin | 0.05 |
| | Silicone oil *1 | 0.04 |
| | Surfactant *2 | 0.001 |
| | Surfactant *3 | 0.02 |
| | Surfactant *4 | 0.10 |
| | Guanidine picolinate | 0.45 |
| | Polymer *5 | 0.24 |
| Second Layer | Mordant *6 | 2.35 |
| | Polymer *7 | 0.60 |
| | Gelatin | 1.40 |
| | Polymer *5 | 0.21 |
| | High boiling point solvent *8 | 1.40 |
| | Guanidine picolinate | 1.80 |
| | Surfactant *2 | 0.02 |
| First Layer | Gelatin | 0.45 |
| | Surfactant *4 | 0.01 |
| | Polymer *5 | 0.04 |
| | Film hardening agent *9 | 0.30 |
| Polyethylene | laminated paper support (thickness 170μ) | |
| First Backing Layer | Gelatin | 3.25 |
| | Film hardening agent *9 | 0.25 |
| Second Backing Layer | Gelatin | 0.44 |
| | Surfactant *2 | 0.002 |
| | Matting agent *10 | 0.09 |
| | Surfactant *11 | 0.01 |

Silicone Oil *1:

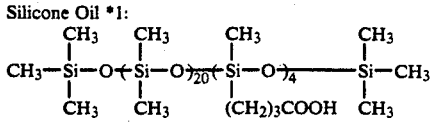

Surfactant *2:
Aerosol ® OR

-continued

Surfactant *3:

$C_8F_{17}SO_2N(C_3H_7)CH_2COOK$

Surfactant *4:

$C_{11}H_{23}CONHCH_2CH_2CH_2N^{\oplus}(CH_3)_2CH_2COO^{\ominus}$

Surfactant *11:

$C_8F_{17}SO_2N(C_3H_7)(CH_2CH_2O)_n(CH_2)_4SO_4Na$ (n: about 4)

Polymer *5:
Vinyl alcohol/sodium acrylate copolymer (75/25 mol ratio)

Polymer *7:
Dextran (Molecular weight 70,000)

Mordant *6:

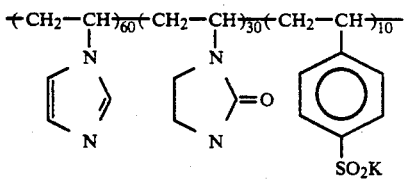

High Boiling Point Organic Solvent *8:
Reofos ® 95 (Made by the Minomoto Co., Inc.)

Film Hardening Agent *9:

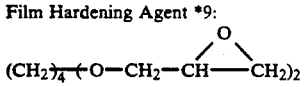

Matting Agent *10:
Benzoguanamine resin (Proportion of particles over 10μ: 18 vol %)

The above mentioned multi-layer color photographic photosensitive materials were exposed for 1 second at 500 lux using a tungsten lamp through G, R and IR tri-color separation filters of which the density varied continuously (the filters used were as follows—G: 500 to 600 nm band pass filter, R: 600 to 700 nm band pass filter, IR: transparent beyond 700 nm). The exposed heat developable photosensitive materials were supplied on the emulsion surface with 15 ml/m$^2$ of water using a wire bar, after which they were laminated with the film surface in contact with the Dye Fixing Material R-1.

The laminates were heated for 25 seconds using a heated roller the temperature of which had been adjusted in such a way that the temperature of the moistened film was raised to 93° C. and, on subsequently peeling the dye fixing materials away from the photosensitive material, distinct yellow, magenta and cyan images, corresponding to the G, R and IR tri-color separation filters, were obtained on the fixing material. The densities of the yellow and magenta dye images were measured using a Macbeth reflection densitometer (RD-519) and the results obtained were as shown in Table 3.

TABLE 2

| Photosensitive Material | Compound Added to the Third Layer | | Compound added to the Fifth Layer | |
|---|---|---|---|---|
| | Compound Number | Amount Added | Compound Number | Amount Added |
| 200 (Comparative Example) | — | — | — | — |
| 201 (Comparative Example) | A | $2.6 \times 10^{-2}$ | A | $3.3 \times 10^{-2}$ |
| 202 (Comparative Example) | B | $2.4 \times 10^{-3}$ | C | $2.0 \times 10^{-3}$ |
| 203 (This Invention) | 2 | $1.2 \times 10^{-3}$ | 2 | $1.7 \times 10^{-3}$ |
| 204 (This Invention) | 2 | $1.2 \times 10^{-3}$ | 4 | $2.1 \times 10^{-3}$ |
| 205 (This Invention) | 6 | $1.4 \times 10^{-3}$ | 6 | $1.4 \times 10^{-3}$ |
| 206 (This Invention) | 8 | $1.3 \times 10^{-3}$ | 10 | $1.5 \times 10^{-3}$ |
| 207 (This Invention) | 2 | $1.2 \times 10^{-3}$ | 11 | $1.2 \times 10^{-3}$ |
| 208 (This Invention) | 20 | $8.0 \times 10^{-4}$ | 18 | $1.4 \times 10^{-3}$ |

TABLE 3

| Photosensitive Material | Yellow | | Magenta | |
|---|---|---|---|---|
| | $D_{min}$ | $D_{max}$ | $D_{min}$ | $D_{max}$ |
| 200 (Comparative Example) | 0.37 | 2.05 | 0.41 | 2.21 |
| 201 (Comparative Example) | 0.21 | 1.70 | 0.25 | 1.75 |
| 202 (Comparative Example) | 0.18 | 1.82 | 0.20 | 1.87 |
| 203 (This Invention) | 0.13 | 2.03 | 0.15 | 2.22 |
| 204 (This Invention) | 0.13 | 2.10 | 0.14 | 2.15 |
| 205 (This Invention) | 0.15 | 1.98 | 0.16 | 2.20 |
| 206 (This Invention) | 0.14 | 2.00 | 0.14 | 2.08 |
| 207 (This Invention) | 0.16 | 2.07 | 0.16 | 2.10 |
| 208 (This Invention) | 0.13 | 1.97 | 0.15 | 2.17 |

It is clear from Table 3 that heat developable photosensitive materials which have a low fog density were obtained by using compounds of the present invention.

While the invention has been described in detail and with reference to specific embodiments thereof, it will be apparent to one skilled in the art that various changes and modifications can be made therein without departing from the spirit and scope thereof.

What is claimed is:

1. A heat developable photosensitive material comprising a support having thereon, (i) at least one photosensitive silver halide emulsion layer which contains at least one compound selected from among the compounds represented by formulas [I] and [III]:

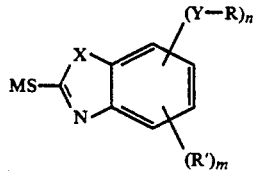

[I]

wherein Y represents $-NSO_2-$ or $-N(R_1)SO_2N(R_2)(R_3)-$;

R represents an unsubstituted alkyl group; X represents —O—, —S— or

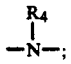

M represents a hydrogen atom, an alkali metal atom, an ammonium group or a group which cleaves under alkaline conditions; R' represents a hydrogen atom or a substituent group; $R_1$, $R_2$, $R_3$ and $R_4$ each represent a hydrogen atom or an alkyl group; n represents 1 or 2; m represents 4−n;

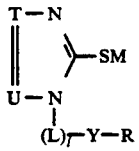

[III]

wherein T and U each represent

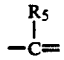

or —N=; $R_5$ represents a hydrogen atom, a halogen atom, a hydroxyl group, a nitro group, an alkyl group, an alkenyl group, an aralkyl group, an aryl group, a carbonamido group, a sulfonamido group, a ureido group or a thioureido group; L represents an alkylene group, an alkenylene group, an aralkylene group or an arylene group; l represents 0 or 1; and Y, R and M have the same meanings as the respective groups in formula [I]; and (ii) a dye compound represented by formula [LI]:

$$[\text{Dye-Y}]_n\text{-Z} \qquad [\text{LI}]$$

wherein Dye represents a dye group which has been temporarily shifted to the short wave length side or a dye precursor group; Y represents a simple bond or a linking group; Z represents a group which produces a difference in the diffusibility of the compound represented by $(\text{Dye-Y})_n$-Z, or which releases Dye and produces a difference between the diffusibilities of the released Dye and $(\text{Dye-Y})_n$-Z, in accordance or in counter-accordance with a photosensitive silver salt which imagewise has a latent image; n represents 1 or 2; and when n is 2, the two Dye-Y moieties may be the same or different.

2. The heat developable photosensitive material of claim 1, wherein Y represents —$NHSO_2$—, R represents an unsubstituted alkyl group having 1 to 4 carbon atoms, and n is 1.

3. The heat developable photosensitive material of claim 1, comprising a compound represented by formula [I].

4. The heat developable photosensitive material of claim 3, wherein R' represents a hydrogen atom or an alkyl group having 1 to 4 carbon atoms.

5. The heat developable photosensitive material of claim 1, comprising a compound represented by formula [III], wherein $R_5$ represents a hydrogen atom or an alkyl group having 1 to 4 carbon atoms, L represents an alkylene group having 1 to 4 carbon atoms or an arylene group having 6 to 8 carbon atoms, and l represents 1.

6. The heat developable photosensitive material of claim 1, further comprising an electron transfer agent or a precursor thereof selected form the group consisting of a 1-phenyl-3-pyrazolidone and an aminophenol.

7. The heat developable photosensitive material of claim 1, further comprising on the support, a binder, an electron transfer agent or a precursor thereof, an electron donor or a precursor thereof, and a reducible dye providing compound which releases a diffusible dye on reduction.

8. The heat developable photosensitive material of claim 1, comprising a reducible dye providing compound of formula [CI]:

$$\text{PWR-(Time)}_t\text{-Dye} \qquad [\text{CI}]$$

wherein PWR is a group which releases $\text{-(Time)}_t$-Dye on reduction; Time represents a group which releases Dye via a reaction following release as $\text{-(Time)}_t$-Dye; t represents an integer of 0 or 1; and Dye represents a dye or a dye precursor.

* * * * *

UNITED STATES PATENT AND TRADEMARK OFFICE

CERTIFICATE OF CORRECTION

PATENT NO. : 5,316,886

DATED : May 31, 1994

INVENTOR(S) : Tomoyuki Koide et al

It is certified that error appears in the above-indentified patent and that said Letters Patent is hereby corrected as shown below:

Title page, left hand column, lines 9-11, please delete as follows:

[*] Notice: The portion of the term of this patent subsequent to Jan. 21, 2009 has been disclaimed.

Signed and Sealed this

Thirteenth Day of September, 1994

*Attest:*

*Attesting Officer*

BRUCE LEHMAN

*Commissioner of Patents and Trademarks*